US007323957B2

(12) United States Patent
Menard et al.

(10) Patent No.: US 7,323,957 B2
(45) Date of Patent: Jan. 29, 2008

(54) ELECTRO-MECHANICAL RELAY

(75) Inventors: Stephane Menard, Kirkland (CA); Jun Lu, LaSalle (CA)

(73) Assignee: Simpler Networks, Inc., Dorval (CA)

( * ) Notice: Subject to any disclaimer, the term of this patent is extended or adjusted under 35 U.S.C. 154(b) by 295 days.

(21) Appl. No.: 11/146,459

(22) Filed: Jun. 7, 2005

(65) Prior Publication Data

US 2005/0270129 A1 Dec. 8, 2005

Related U.S. Application Data

(60) Provisional application No. 60/577,177, filed on Jun. 7, 2004.

(51) Int. Cl.
*H01H 51/22* (2006.01)

(52) U.S. Cl. ..... 335/80; 335/128; 200/260; 200/339

(58) Field of Classification Search ..... 335/1–204, 335/78–83

See application file for complete search history.

(56) References Cited

U.S. PATENT DOCUMENTS 3,840,176 A * 10/1974 Baysinger ..... 236/44 R
4,355,292 A * 10/1982 Ludi et al. ..... 335/145
4,414,519 A * 11/1983 Anderson et al. ..... 335/208
7,135,953 B2 * 11/2006 Leitl et al. ..... 337/84
7,179,116 B2 * 2/2007 Menard et al. ..... 439/442
2006/0166565 A1 * 7/2006 Menard et al. ..... 439/730
2007/0024403 A1 * 2/2007 Kwon et al. ..... 335/78

* cited by examiner

*Primary Examiner*—Elvin Enad
*Assistant Examiner*—Mohamad A Musleh
(74) *Attorney, Agent, or Firm*—Seyfarth Shaw LLP

(57) ABSTRACT

The electro-mechanical relay comprises a base having a transversal axis and a rocking member operatively connected over the base. The rocking member is pivotable, with reference to the transversal axis, between a first position and a second position. The relay also comprises a first contact provided on the base at a location facing the rocking member and being spaced-apart from the transversal axis, and a second contact having at least a portion provided on the rocking member and being in registry with the first contact. The first and second contacts are configured and disposed to be electrically engaged at the first position of the rocking member, and electrically disengaged from each other at the second position thereof.

13 Claims, 43 Drawing Sheets

ELECTRO-MECHANICAL RELAY

CROSS-REFERENCE TO PRIOR APPLICATION

The present application claims priority over U.S. patent application No. 60/577,177 filed Jun. 7, 2004 and entitled "ELECTRO-MECHANICAL RELAY (EMR)", the content of which is hereby incorporated by reference.

BACKGROUND

Telecommunication, automotive, automated test equipment and many other applications typically use many EMRs in their products. The need for smaller, better performance and more cost efficient EMRs is driven by the manufacturers of equipment which require their systems to be cheaper, denser while offering an enhance feature so as to gain market share and to be more competitive. There is therefore a constant need to provide very reliable EMRs that are less costly to manufacture than conventional ones and which are also smaller in order to provide the density the equipment manufacturers have been striving for.

SUMMARY

The present EMR, unlike the ones using conventional electromagnetic actuator mechanisms, is provided with new thermal actuator mechanisms using a heat-shrinkable wire, such as one made of a Nickel-Titanium alloy. These new actuator mechanisms enable significant cost and size reduction. They also enable new EMR internal architectures.

In a first aspect, there is provided an electro-mechanical relay, comprising: a base having a transversal axis; a rocking member operatively connected over the base, the rocking member being pivotable, with reference to the transversal axis, between a first position and a second position; a set of contacts comprising: a first contact provided on the base at a location facing the rocking member and being spaced-apart from the transversal axis; a second contact having at least a portion provided on the rocking member and being in registry with the first contact, the first and second contacts being configured and disposed to be electrically engaged at the first position of the rocking member, and electrically disengaged from each other at the second position thereof. The relay also comprises means for biasing the rocking member towards either the first position or the second position thereof; and a pulling assembly mounted between the rocking member and a fixed location with reference to the base, the pulling assembly comprising a heat-shrinkable wire and being provided to selectively move the rocking member either towards the second position thereof when the means for biasing the rocking member are designed to bias the rocking member towards the first position thereof, or towards the first position thereof when the means for biasing the rocking member are designed to bias the rocking member towards the second position thereof.

DETAILED DESCRIPTION

Figure 1:
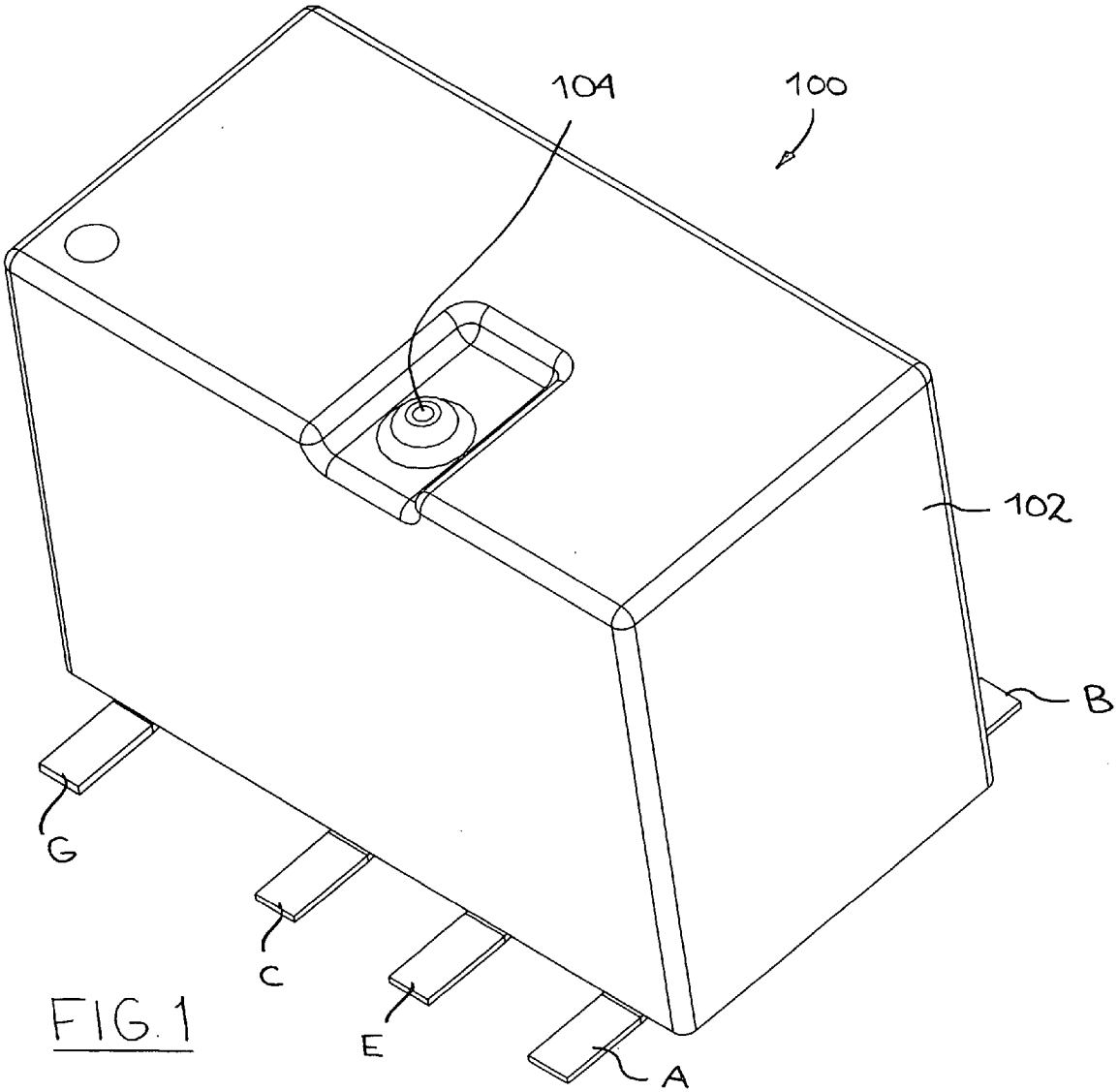
FIG. 1 is a top perspective view of an example of an assembled EMR in accordance with a possible embodiment.
Figure 2:
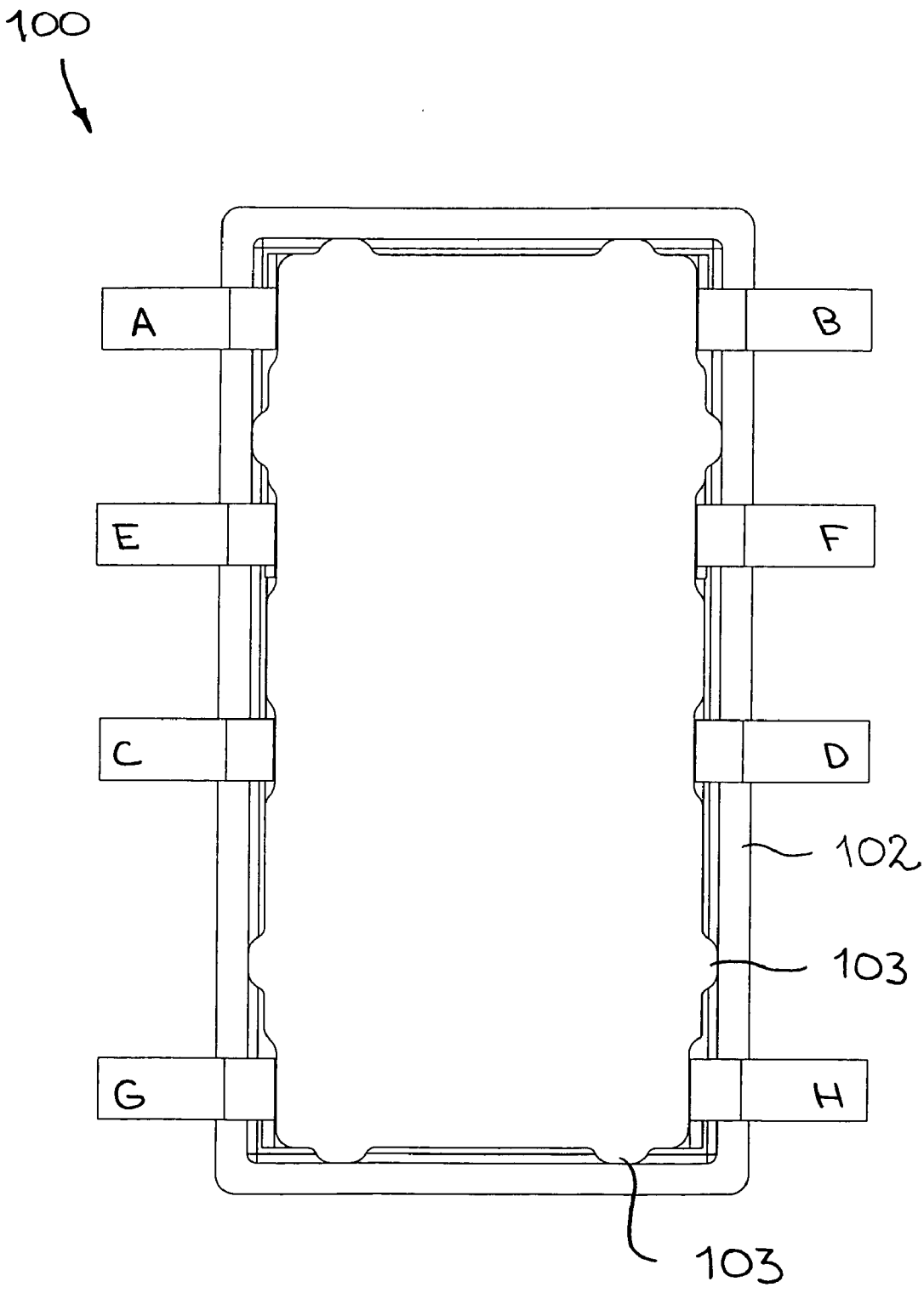
FIG. 2 is a bottom plan view of the EMR of FIG. 1.

FIGS. 1 to 14 show an example of an EMR (100) in accordance with a possible embodiment. FIGS. 1 and 2 illustrate the assembled EMR (100). The actual size of this EMR (100) would typically be about 4 mm by 8 mm by 5 mm. Of course, this EMR (100) can be designed larger or smaller, depending on the needs. Other variations of the EMR (100) could be made to ensure that it is compatible with, for instance, existing telecommunications systems and therefore be used as a replacement part.

The illustrated EMR (100) has 8 pins. As explained later in the text, these pins act as terminals which are interfaced with corresponding connection points on the printed circuit board (PCB) or socket over which they will be mounted.

Pins A and B form a first pair of output terminals. Pins C and D form a second pair of output terminals. Pins E and F form a pair of input terminals. The EMR (100) has two internal positions. In the first position, pin E is electrically connected to pin C and pin F is electrically connected to pin D. In the second position, pin E is electrically connected to pin A and pin F to pin B. The EMR (100) thus allows selecting which among the first pair (pins A and B) and the second pair (pins C and D) of output terminals will be electrically connected to the input terminals (pins E and F). The second output pair (pins C and D) is referred to as the normally open contacts (NOC). When no controlled voltage is applied between pins G and H, the EMR (100) is set so that pins C and D are the output terminals. Therefore, pins C and D are then electrically connected to pins E and F, respectively. The first output pair (pins A and B) is referred to as the normally closed contact (NCC) and when a controlled voltage is applied between pins G and H, the already established connection between pins C and D and pins E and F, respectively, are then disconnected and pins E and F are then electrically connected to pins A and B, respectively.

It should be noted that it is possible to use the EMR (100) in a context where there are two possible inputs, and one output. The EMR (100) would then be used to select which pair of input terminals (pins A and B, or pins C and D) is used.

Another possible way of constructing the EMR (100) would be to have only one side of input and output pins. For instance, one could provide only pins A, C and E. Pins G and H will still be needed for the control voltage. Furthermore, it is further possible to use the EMR (100) as an "on" and "off" type relay. For instance, pin C can be either omitted completely from the design or simply not connected to an active lead on the PCB.

FIG. 1 shows an assembled EMR, including the protective cap (102). This figure shows that the protective cap (102) comprises a vent (104). The vent (104) is used during the manufacturing process to release gas pressure inside the EMR (100). The vent (104) is closed once the parts are cooled. It prevents an internal pressure build up, which may damage the components.

FIG. 2 shows the positions of the various pins, as viewed from the bottom. It also shows that the protective cap (102) is aligned using pairs of alignment bosses (103) provided on each side. These alignment bosses (103) are also visible in some of the other figures.

Figure 3:
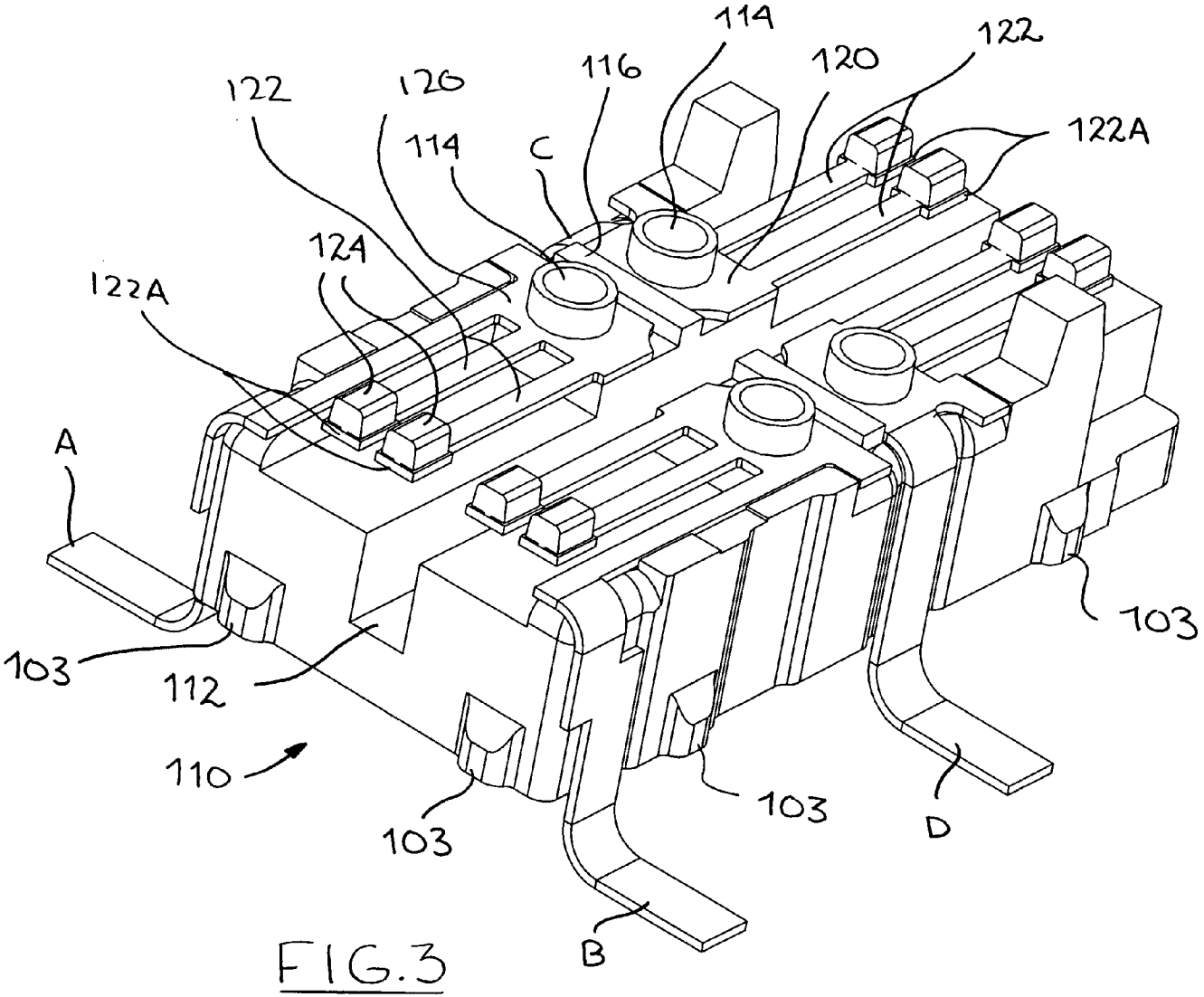
FIG. 3 is a front top perspective view of the base and some of its surrounding elements in the EMR of FIG. 1.

FIG. 3 shows the base (110) of the EMR (100). This relatively complex part comprises a plurality of walls, recesses, holes and other sub-parts which are used to accommodate some of the other components of the EMR (100). This base (110) features a central longitudinal channel (112).

The base (110) is made of a dielectric material, such as a plastic material. It should be noted here that the exact shape of the base (110), or any of the other parts, may be different than what is illustrated herein. Moreover, it should be noted that the metallic parts can have a different shape than what is illustrated, especially during the manufacturing process.

One possible manufacturing method of the plastic parts of the EMR (100) is to use injection molding and stamping. Some parts would then be manufactured directly over other parts instead of being manufactured separately and later assembled. The exact shape of the parts would then be slightly different. Injection molding is useful for mass-producing parts.

A set of 4 pegs (114) is provided on the upper side of the base (110). These pegs (114) are used to retain the output pins A, B, C and D. Each of these pins is electrically independent. The internal end of each pin comprises a plate (120) from which two cantilever arms (122) project. Each of these cantilever arms (122) comprises a contact pad (122A) on which a corresponding electrode (124) is attached. The plates (120) are attached over the corresponding pegs (114) by heat fusion of the pegs (114). These parts can also be overmolded to achieve the same result. A small wall (116) is provided between adjacent plates (120) on the same side of the base (110) to increase the electric insulation.

It should be noted that many elements that are not identified by a reference numeral in FIG. 3, or in any other figures, correspond to other similar or identical elements that are identified. All elements were not identified to reduce the quantity of reference numerals on the figures, thus improve clarity.

Figure 4:
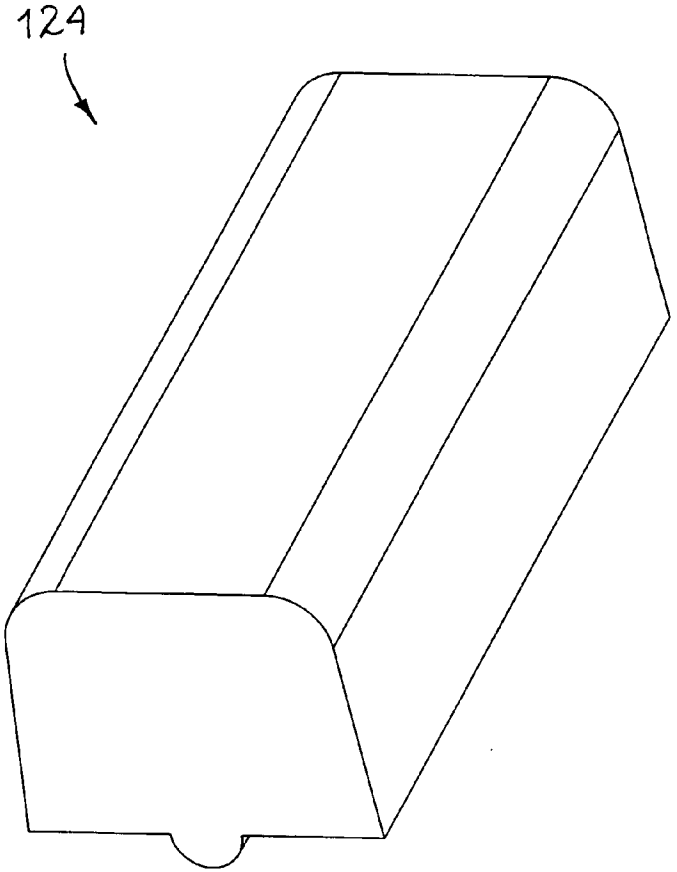
FIG. 4 is a top perspective view of an electrode used in the EMR of FIG. 1.

An enlarged view of an individual electrode (124) is presented in FIG. 4. The electrodes (124) are fused or otherwise bonded to their substrate. They are designed to provide an optimum electrical contact between the parts.

Figure 5:
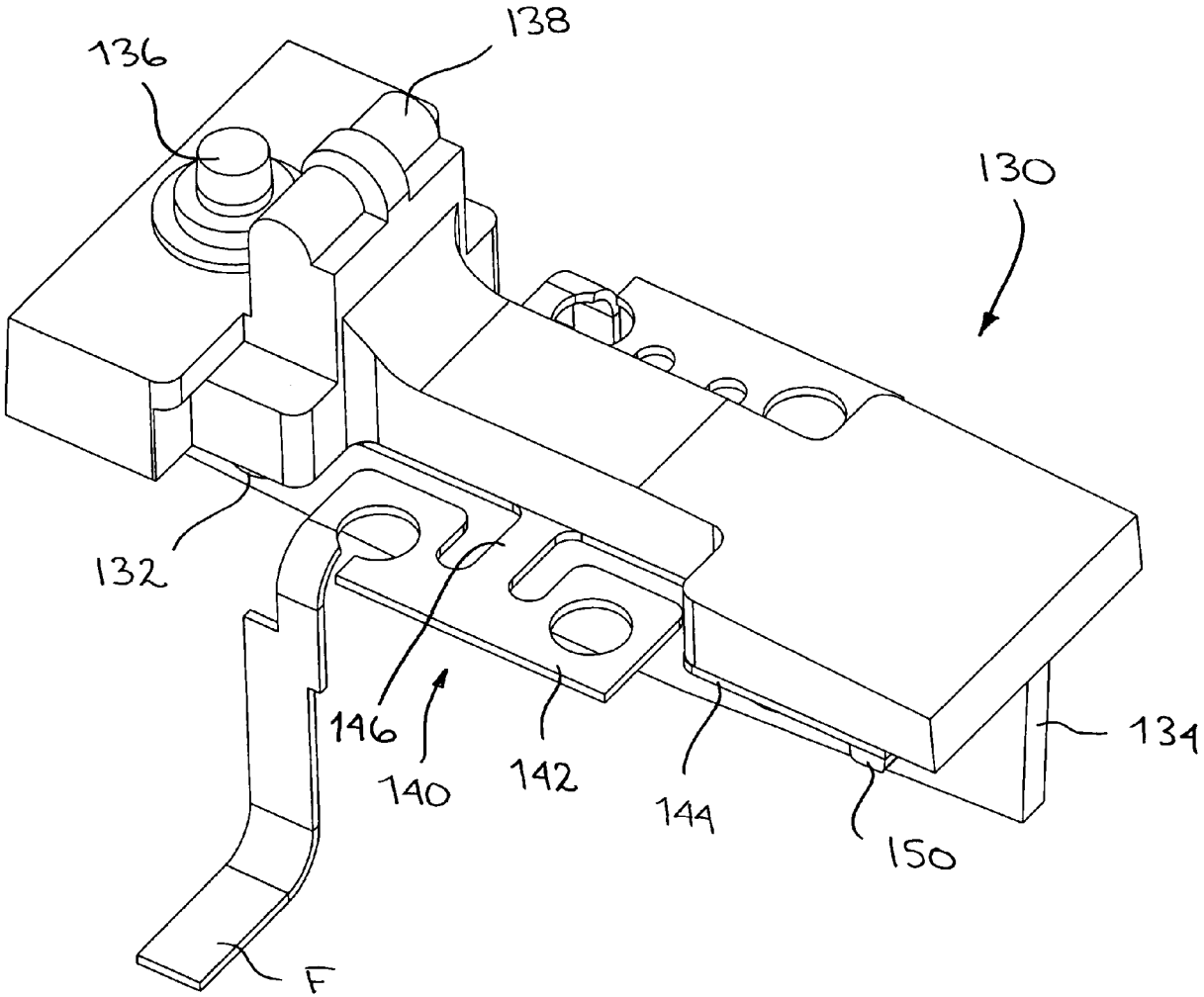
FIG. 5 is a top perspective view of the rocking member and some of its surrounding elements used in the EMR of FIG. 1.
Figure 6:
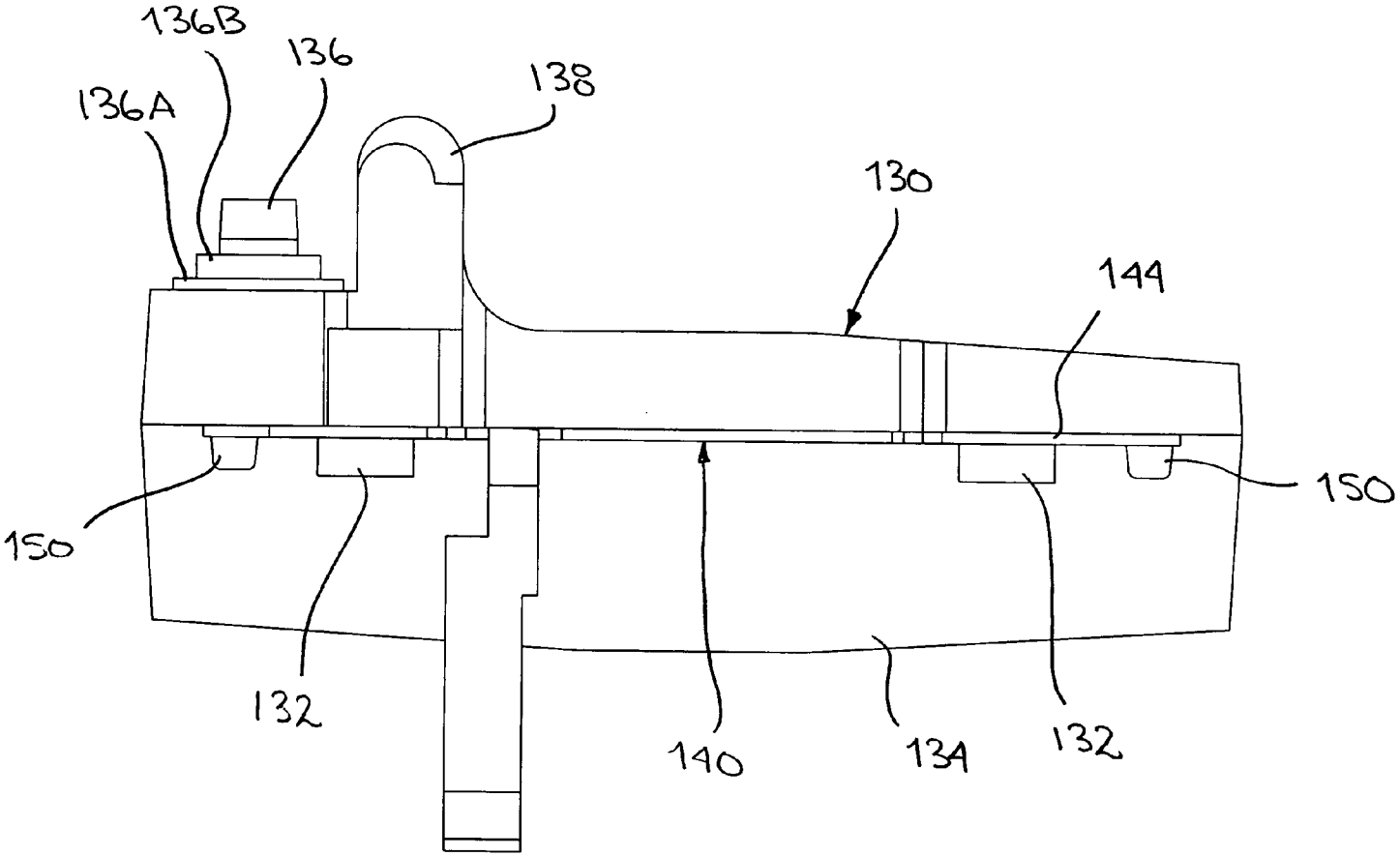
FIG. 6 is a side view of the rocking member and the surrounding elements shown in FIG. 5.
Figure 7:
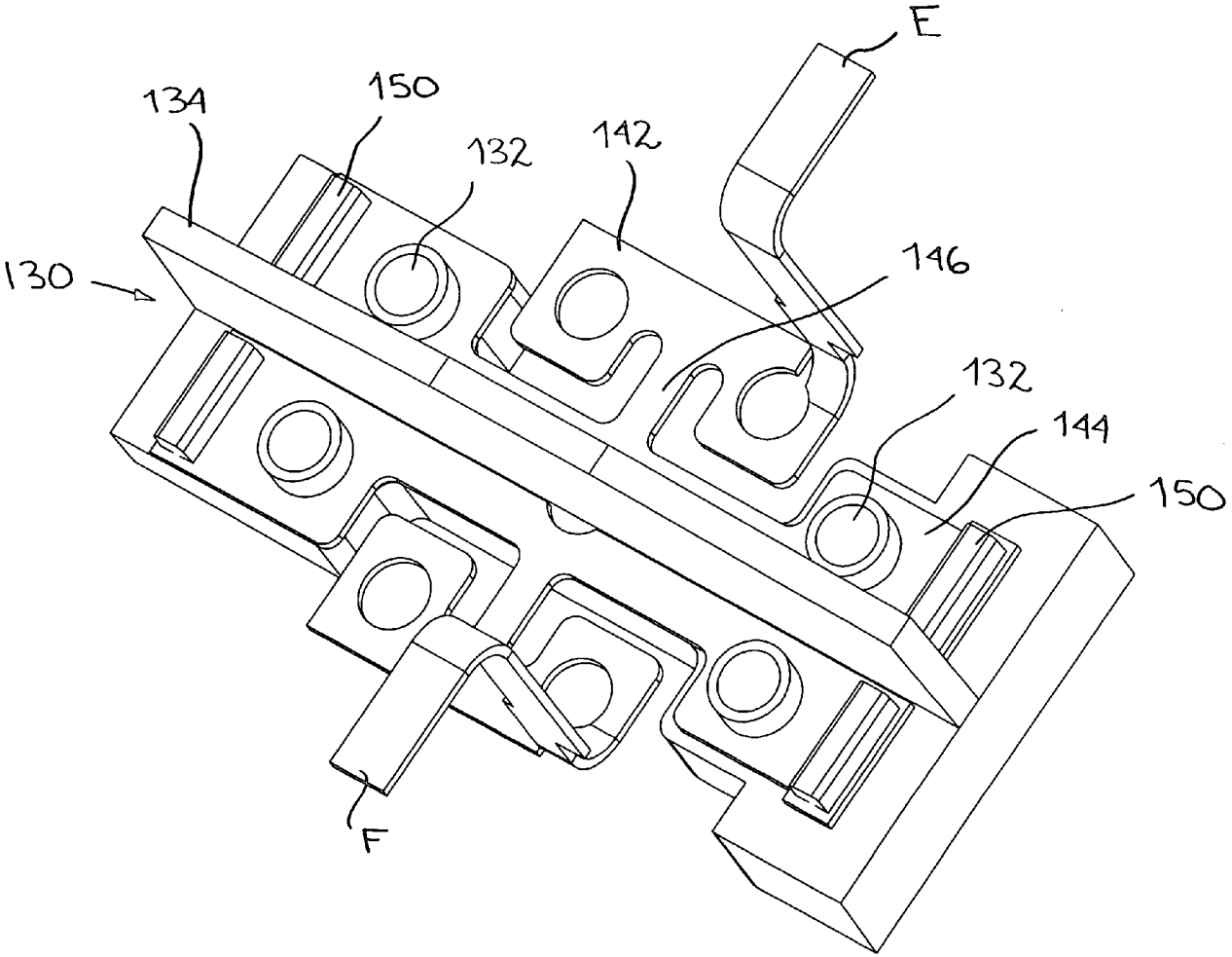
FIG. 7 is a bottom perspective view of the rocking member and the surrounding elements shown in FIG. 5.

FIGS. 5 to 7 show a rocking member (130) that is designed to fit over the base (110). This rocking member (130) is mechanically connected to pins E and F. These pins are electrically independent. The internal end of each of these pins comprises a plate (140) held under the rocking member (130). The plate (140) is divided into two main sections, namely a first connection part (142) and a second connection part (144). These parts (142,144) are connected together using a flexible link (146). The second connection part (144) comprises opposite holes which fit over corresponding pegs (132) downwardly projecting from the rocking member (130). FIG. 7 shows the pegs (132) after the heat fusion used to maintain them on the second connection part (144).

The rocking member (130) further comprises a central longitudinal flange (134). This flange (134) is designed to loosely fit into the central channel (112) of the base (110). Its main purposes are to increase the electric insulation and creepage distance between the left and right sides of the EMR (100).

A set of electrodes (150) is provided on the second connection plates (144). Two electrodes (150) are provided on each connection plate (144), at opposite ends thereof. These electrodes (150) are similar or identical to the electrode (124) that is shown in FIG. 4.

The rocking member (130) further comprises a front upwardly-projecting pin (136) and a rounded upwardly projecting member (138), as shown in FIGS. 5 and 6.

Figure 8:
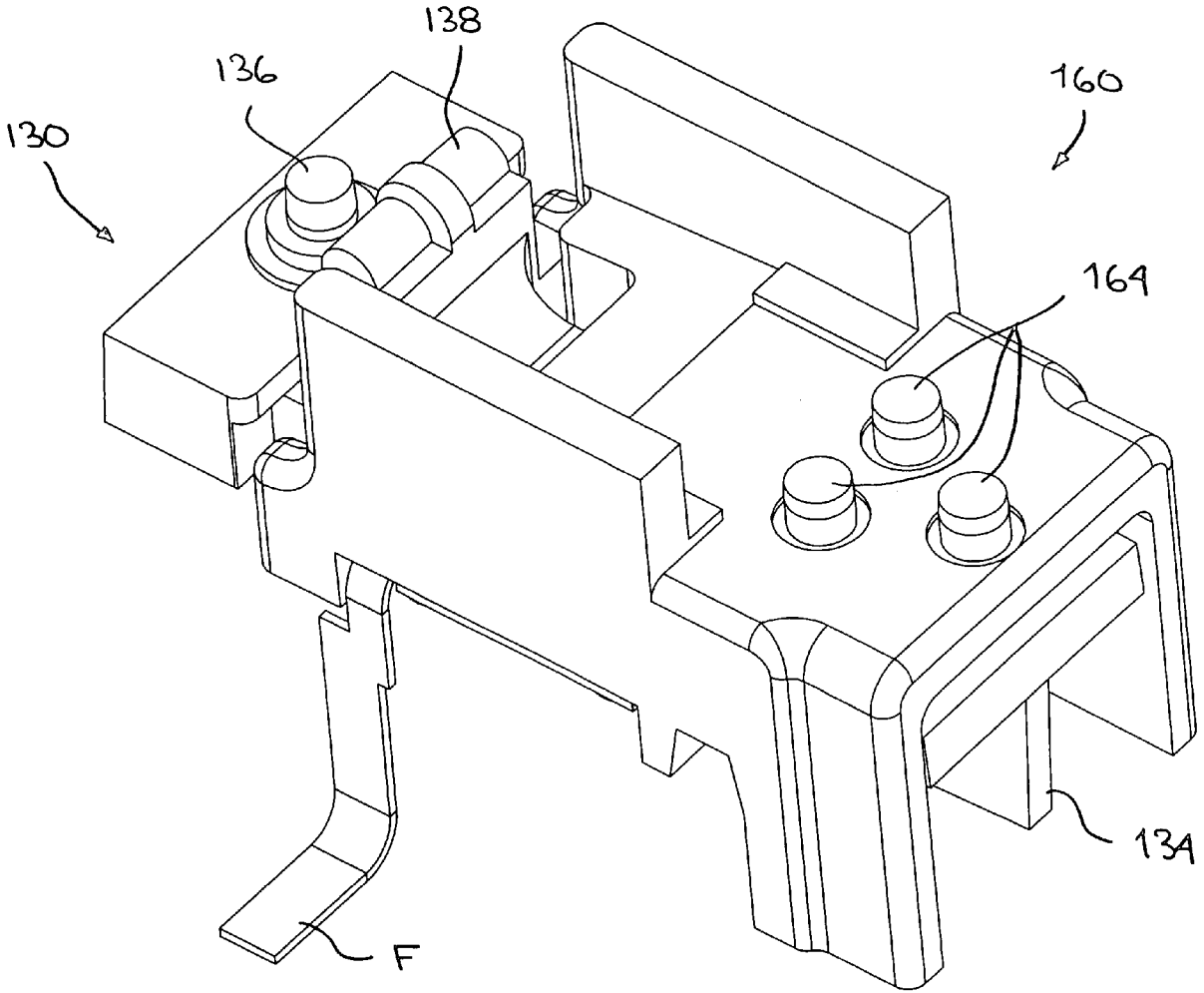
FIG. 8 is a top perspective view of the upper support and the rocking member used in the EMR of FIG. 1.
Figure 9:
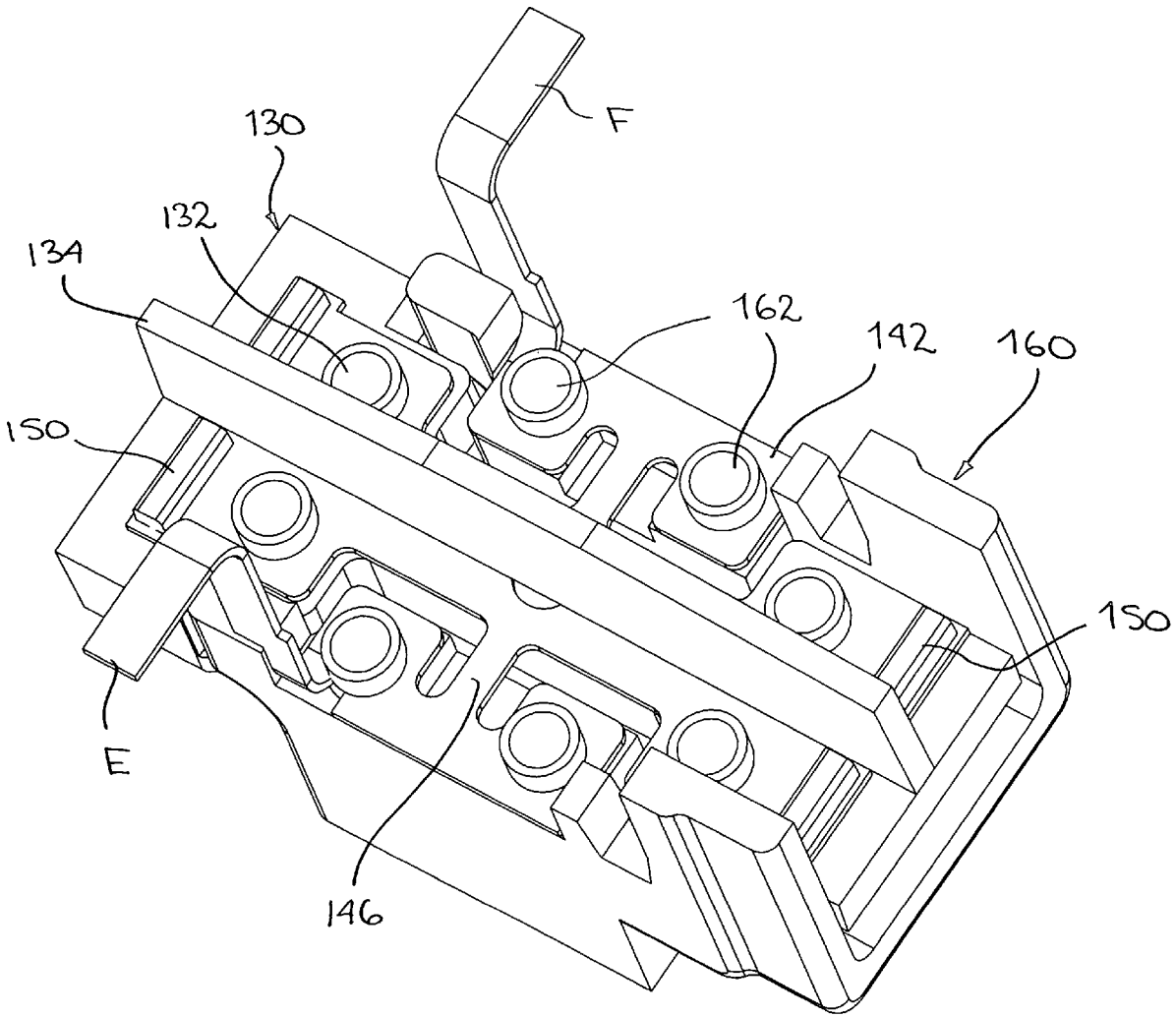
FIG. 9 is a bottom perspective view of the upper support and the rocking member shown in FIG. 8.

FIGS. 8 and 9 show an upper support (160) used to hold the rocking member (130). This upper support (160) is attached to the first connecting plate (142) of the rocking member (130), using holes made therein. Pegs (162), downwardly projecting from the upper part (160), are inserted in these holes. FIG. 9 shows the pegs being heat-fused. Once again, it is also possible to overmold these parts. A small space is provided between the rocking member (130) and the upper support (160) to allow the rocking member (130) to pivot around the flexible links (146).

Figure 10:
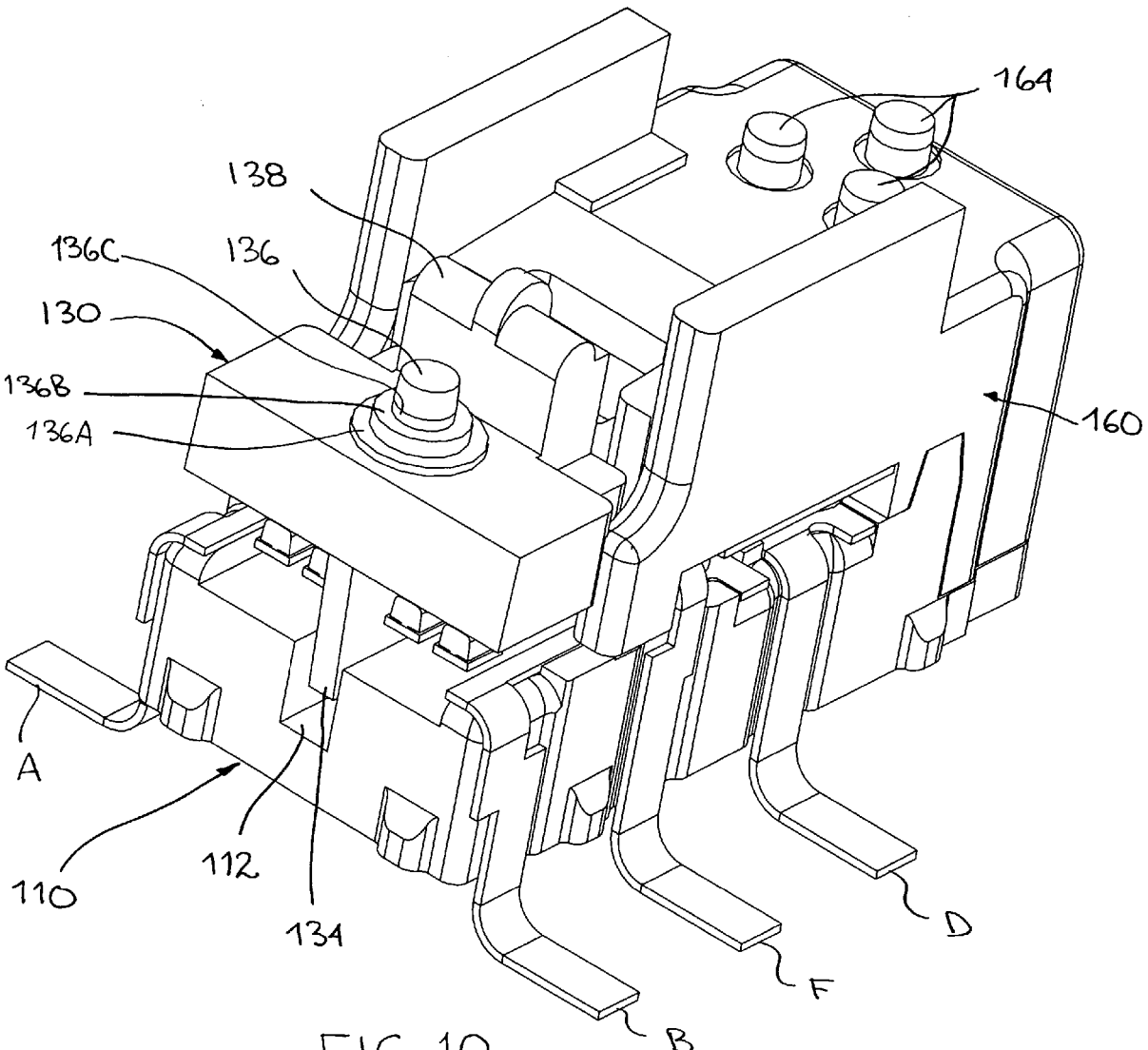
FIG. 10 is a top perspective view of the EMR of FIG. 1, showing the partially-assembled EMR.
Figure 11:
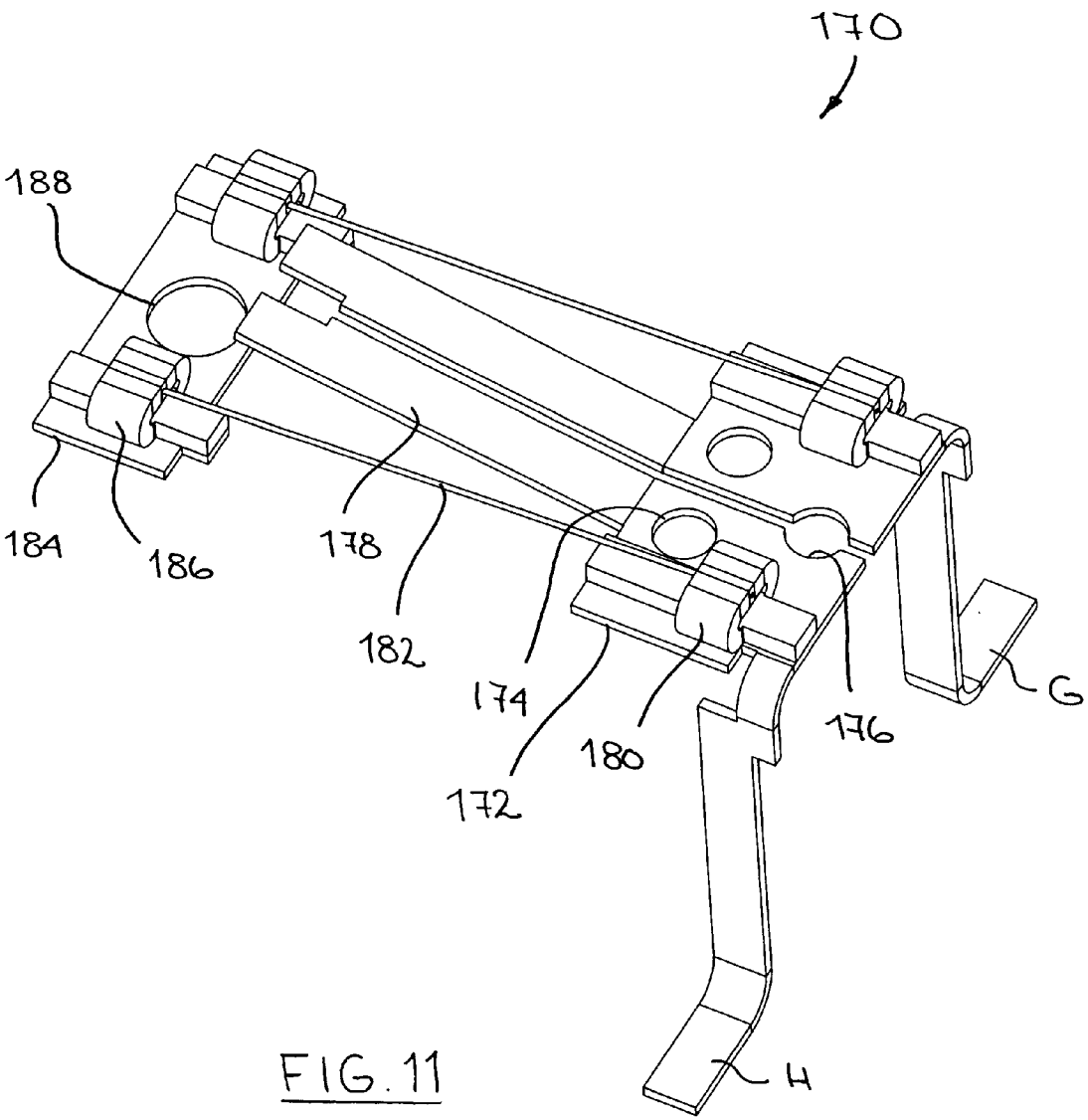
FIG. 11 is a top perspective view of the pulling assembly of the EMR of FIG. 1.
Figure 12:
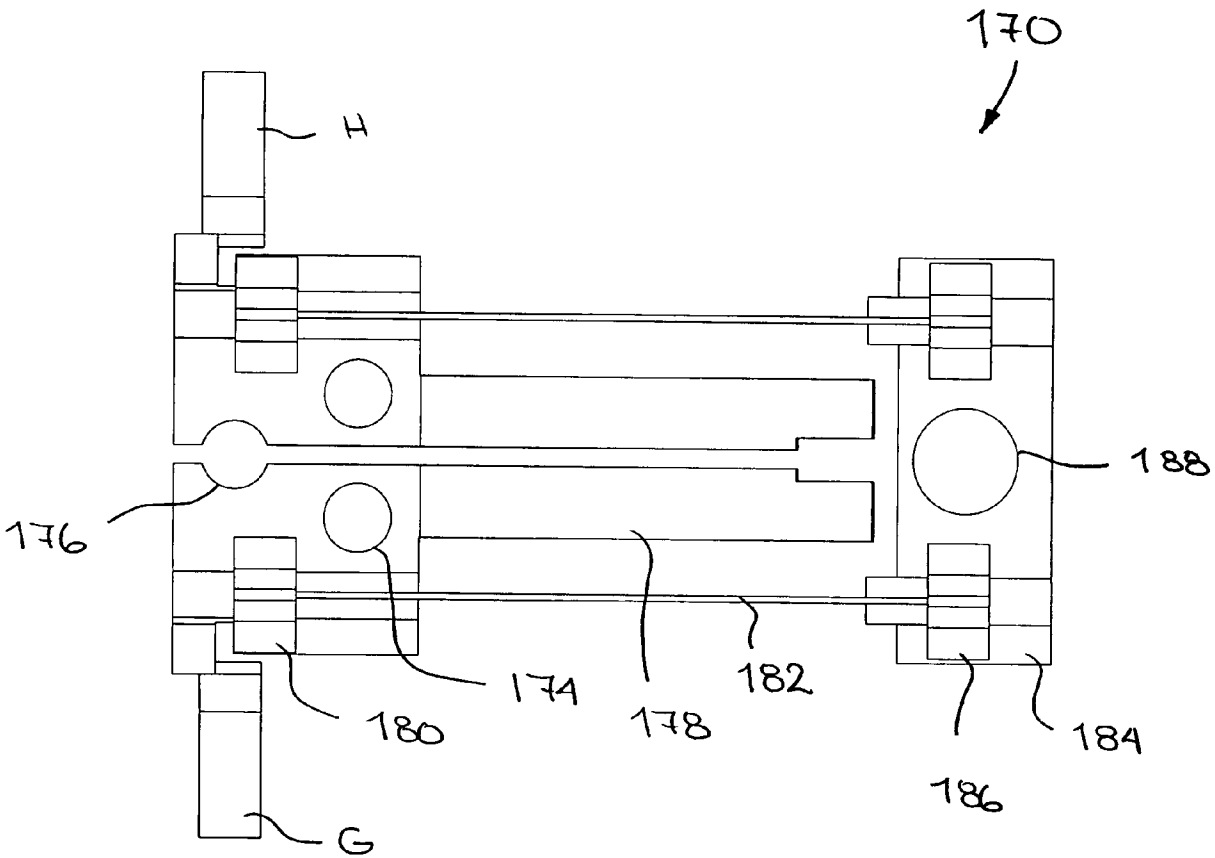
FIG. 12 is a top plan view of the pulling assembly shown in FIG. 11.

FIG. 10 shows the components illustrated in FIGS. 8 and 9, once installed over the base (110).

Three pegs (164) project from the upper surface of the upper support (160). These pegs (164) are designed to hold a first side of a pulling assembly (170), which is individually shown in FIGS. 11 and 12. This pulling assembly (170) is mechanically connected to pins G and H. The internal end of each pin comprises a plate (172), each having a hole (174) to accommodate the corresponding peg (164). Each plate (172) also comprises half of a hole (176) to accommodate a third one of these pegs (164). An inclined elongated and resilient strip (178) forwardly project from each of the plates (172). The bottom surface of these strips (178) engages the projecting member (138). The strips (178) act as a spring and constantly apply a downward force, thereby urging the rocking member (130) towards the NOC position. The strips (178) allows diminishing the release time of the NOC position. Other kinds of spring or springs can be used as well.

Each of the plates (172) further supports a crimp (180) which is used to retain a wire (182), more particularly a heat-shrinkable wire. The opposite end of the wire (182) is attached to a remote floating plate (184) using a second crimp (186). The floating plates (184) comprise a central hole (188). It should be noted that examples of crimps that can be used with the present invention include the ones disclosed in U.S. patent application No. 60/577,185 filed Jun. 7, 2004 and entitled "Collapsing Bridge Crimp", the content of which is hereby incorporated by reference.

Figure 13:
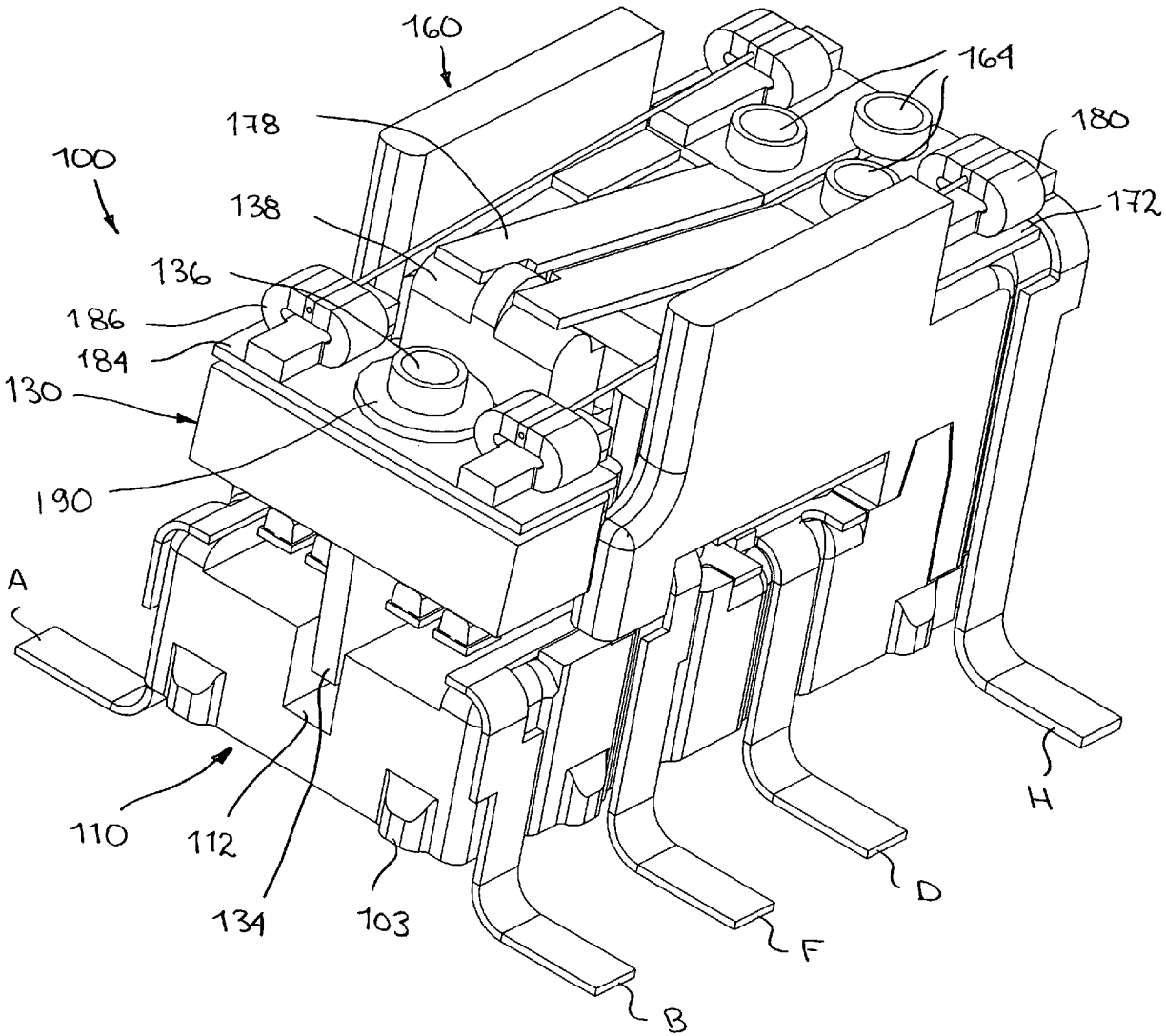
FIG. 13 is a front top perspective view showing the addition of the pulling assembly of FIG. 11 to the partially assembled EMR of FIG. 10.
Figure 14:
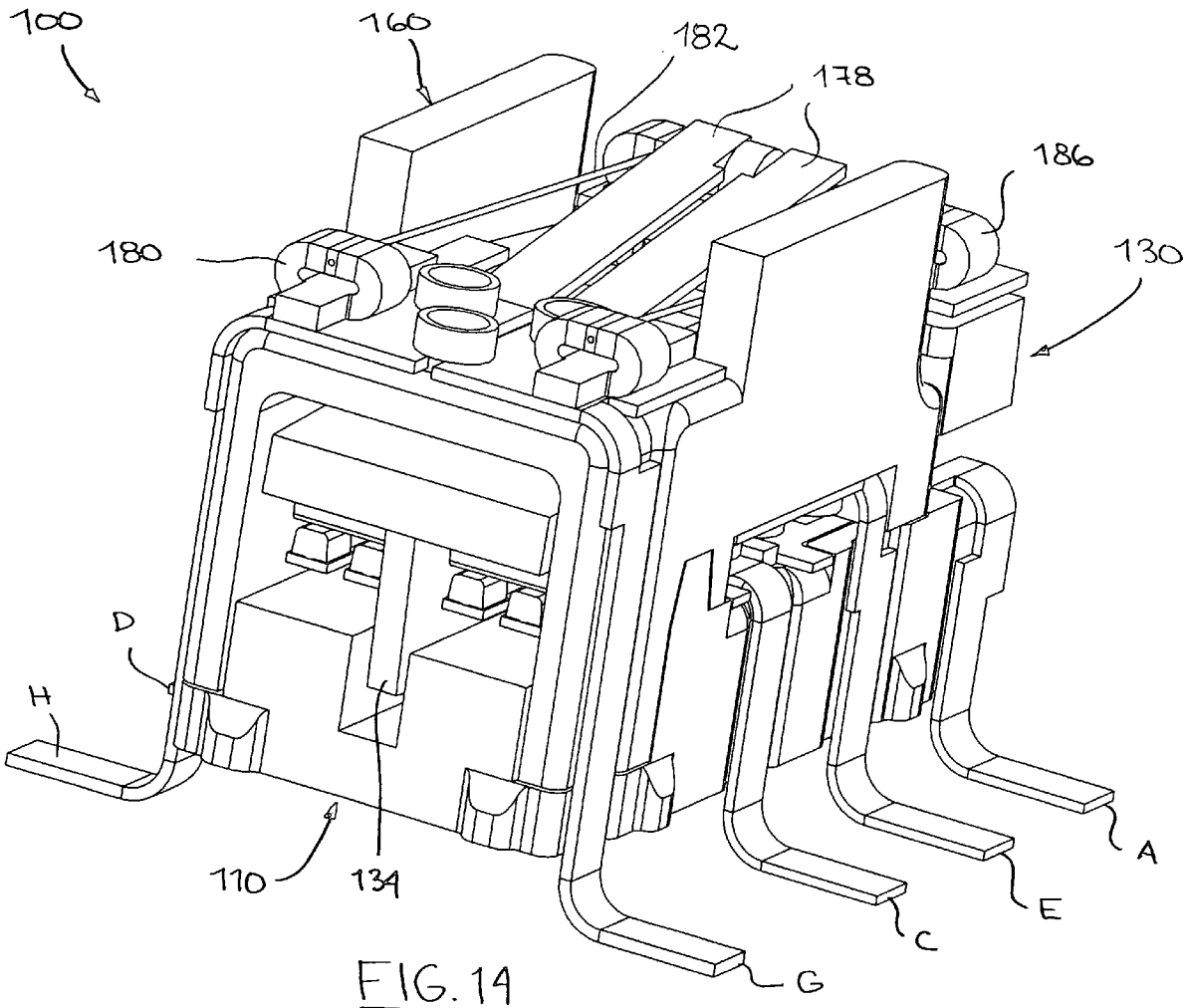
FIG. 14 is a rear top perspective view of what is shown in FIG. 13.

FIGS. 13 and 14 show the pulling assembly (170), once installed over the upper support (160). FIG. 13 shows that the floating plate (184) is set over the pin (136) upwardly projecting from the rocking member (130). The rim of the hole (188) rests over a bottom shoulder (136A), which is identified in FIG. 10. The internal surface of the hole (188) is in contact with an enlarged part (136B) of the pin (136). Finally, the plate (184) is secured using a washer (190) maintained in place in a circular groove (136C) made on the pin (136). This configuration allows the floating plate (184) to slightly pivot so as to compensate any difference in the shrinkage of the wires (182) of the left and right sides.

In use, applying a control voltage between pins G and H will pull the plate (184) and force the rocking member (130) to slightly pivot around the flexible links (146). This will release the contact between pins E and A and between pins F and B, and close the contact between pins E and C, and pins F and D. This position will remain as long as a control voltage is applied between pins G and H.

The EMR described herein was primarily designed to significantly reduce cost and size compared to standard electro-mechanical relays available in the industry today. It should be noted that this EMR can also be used in a very wide range of applications with only minor changes.

First Alternative Model

A first alternative model is shown in FIGS. 15 to 35. In the illustrated EMR (200), 8 pins are provided as with the first illustrated model. Pins A and B form a first pair of output terminals. Pins C and D form a second pair of output terminals. Pins E and F form a pair of input terminals. The EMR (200) allows selecting which one among the first and second pair of output terminals will be used. The pins of the second output pair (pins C and D) are called the normally opened contact (NOC). While there is no voltage applied between pins G and H, pins C and D are connected to pins E and F. Once a control voltage is applied between pins G and H, pins A and B connects to pins E and F, respectively. Pins A and B are referred to as the normally closed contact (NCC).

It should be noted that the same comments concerning alternative configurations set forth in the explanation of the first model also applies to second model.

Figure 15:
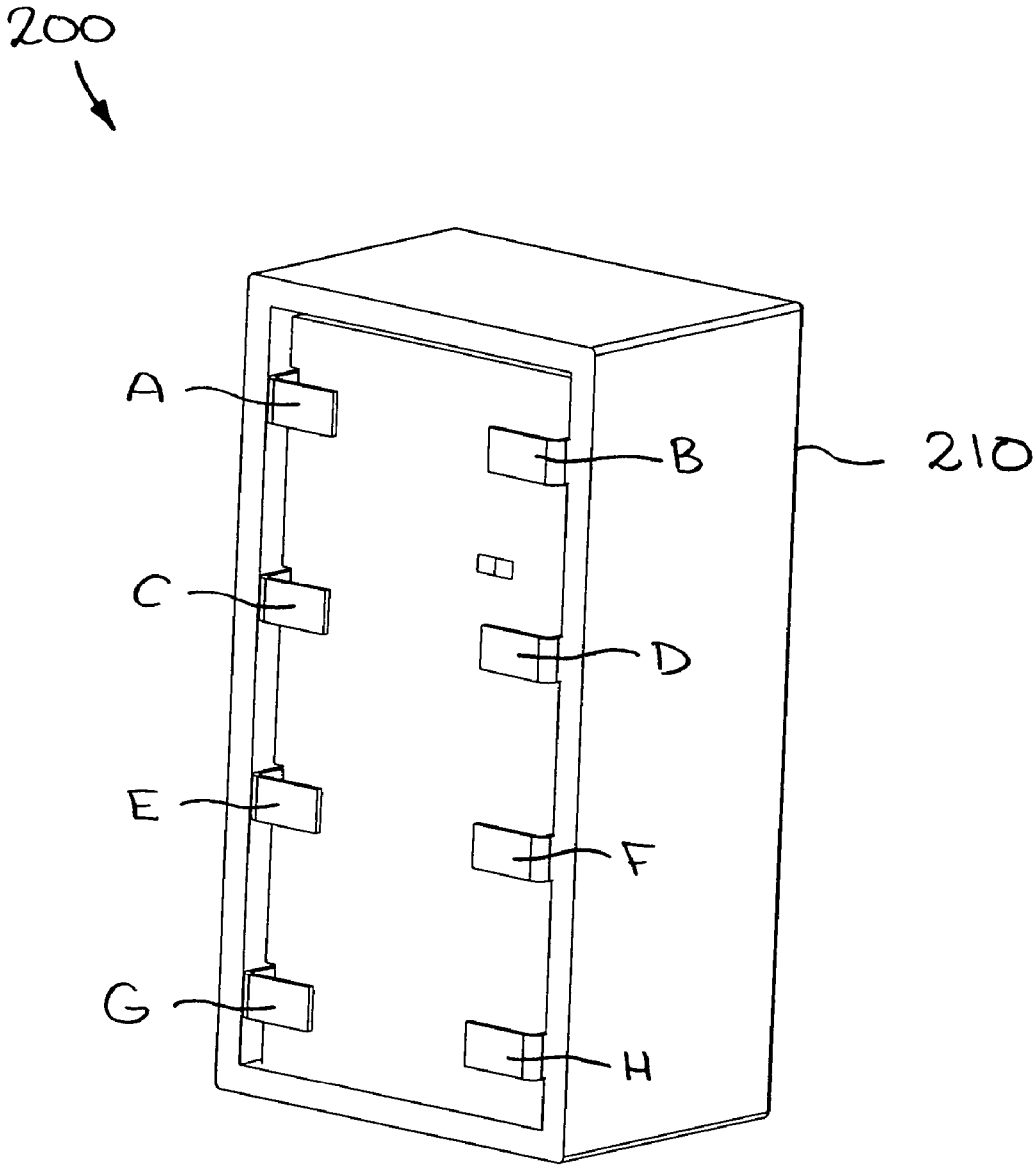
FIG. 15 is a bottom perspective view of an example of an assembled EMR in accordance with a possible alternative embodiment.

FIG. 15 shows the bottom of the EMR (200) and the pin pattern of this model. The pin pattern is slightly different than that of the first model (100). This figure also shows that the EMR (200) comprises a protective cap (210).

Figure 16:
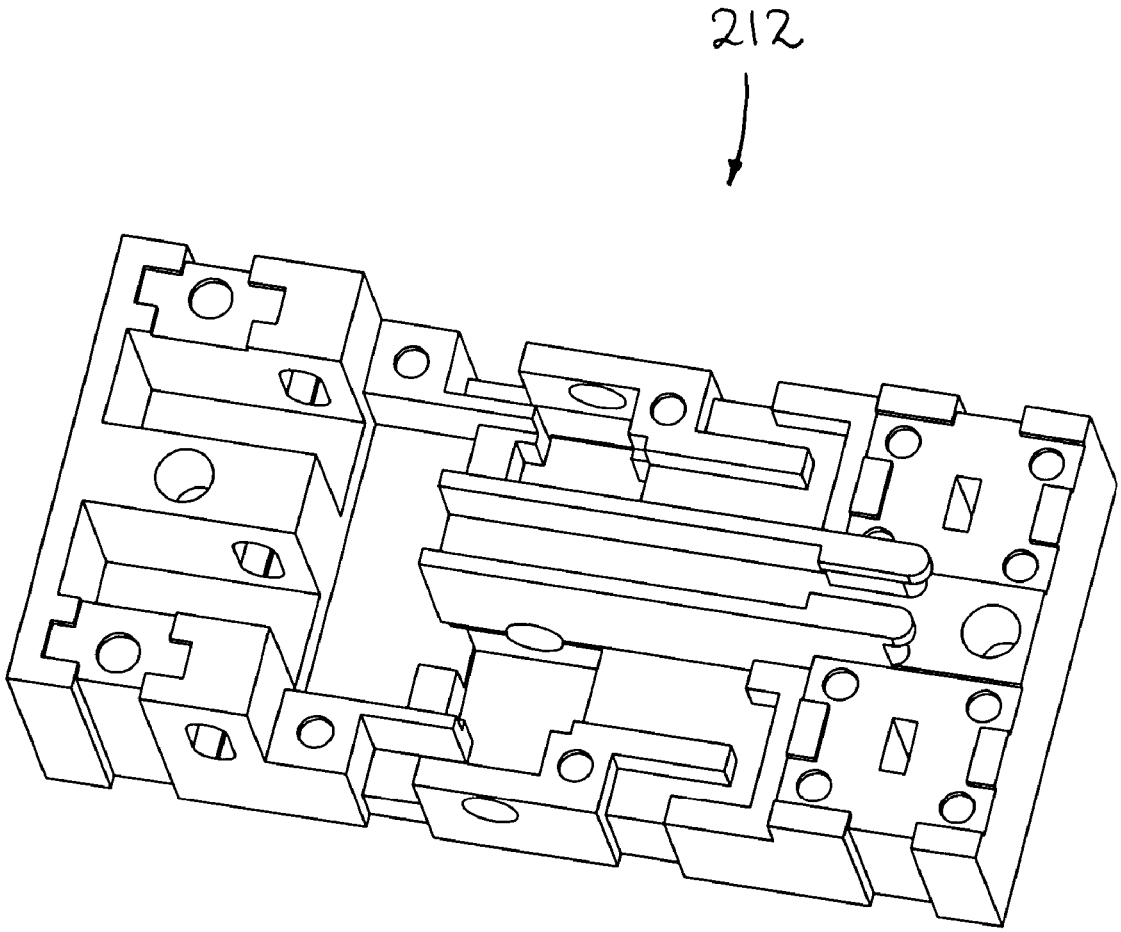
FIG. 16 is a top perspective view of the base used in the EMR of FIG. 15.

FIG. 16 shows the base (212) of the EMR (200). This base (212) is made of a dielectric material, such as a plastic material. It comprises walls and recesses design to accommodate the various elements.

Figure 17:
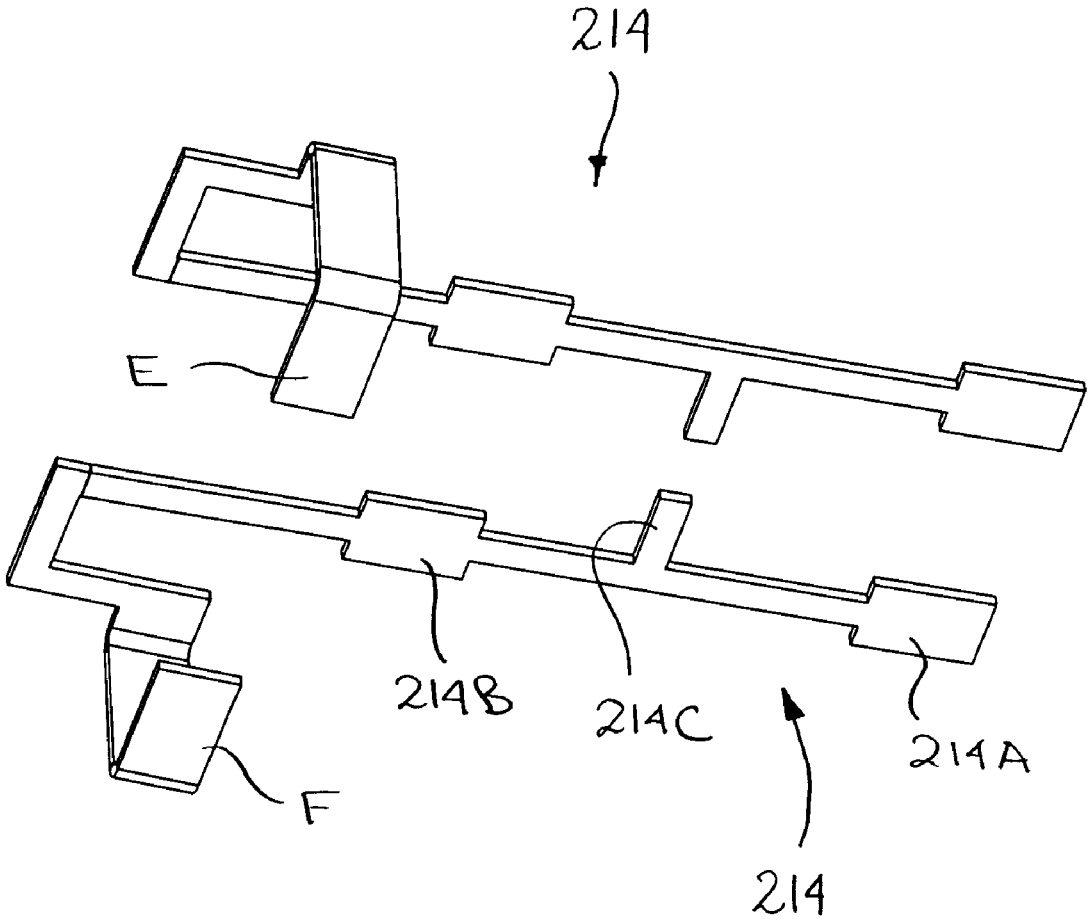
FIG. 17 is a bottom perspective view of the spring arms used in the EMR of FIG. 15.

FIG. 17 is a view from the bottom showing that pins E and F are made integral with respective spring arms (214). Each spring arm (214) preferably comprises a first contact pad (214A) located at the free end thereof, and a second contact pad (214B) located at an intermediate location. Tangs (214C) inwardly project towards each other at a location between the first contact pads (214A) and the second contact pads (214B). The spring arms (214) and the pins (E, F) will be installed in corresponding recesses of the base (212), as it will be explained and shown later.

Figure 18:
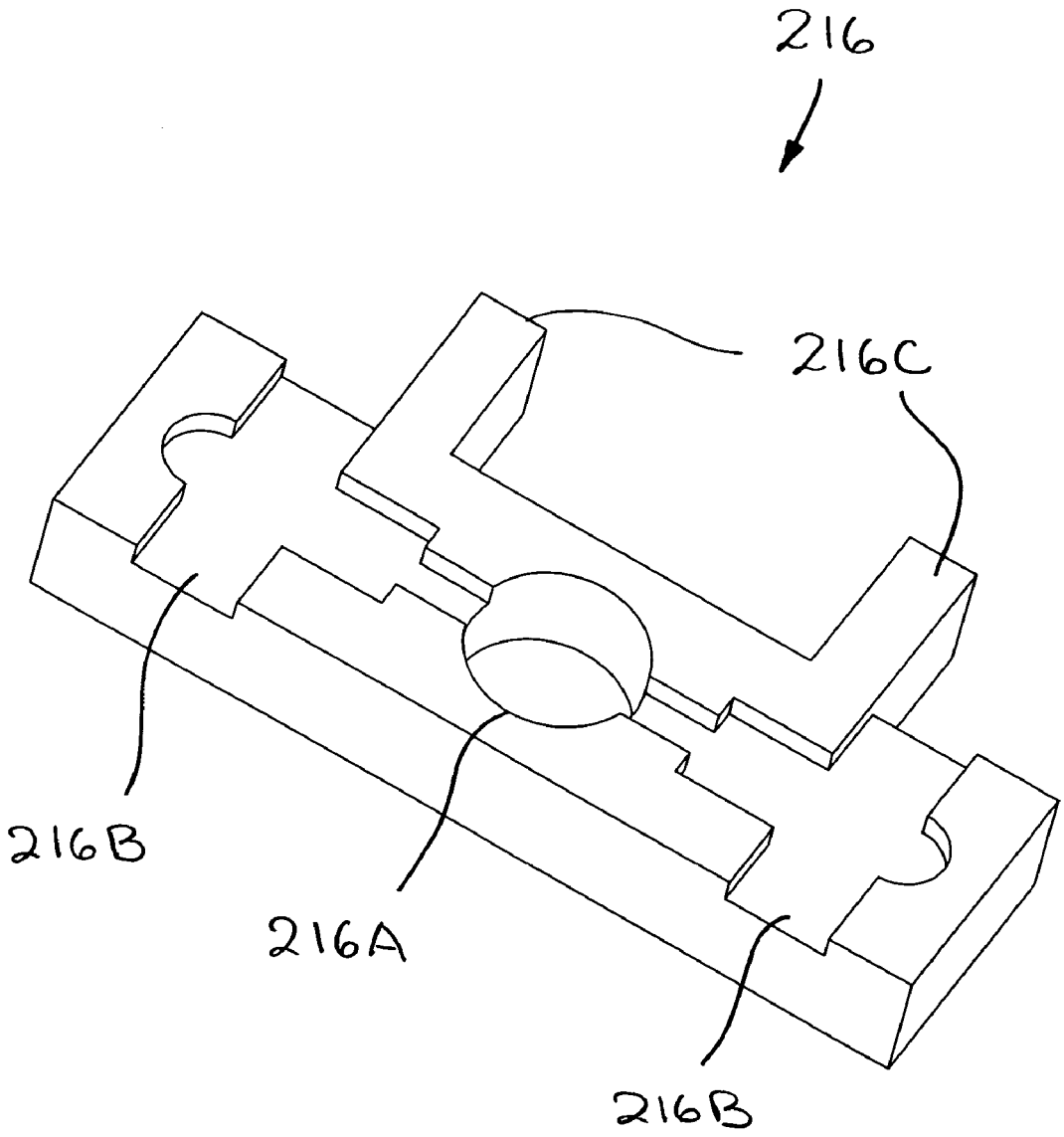
FIG. 18 is a top perspective view of a first part of the pulling assembly used in the EMR of FIG. 15.
Figure 19:
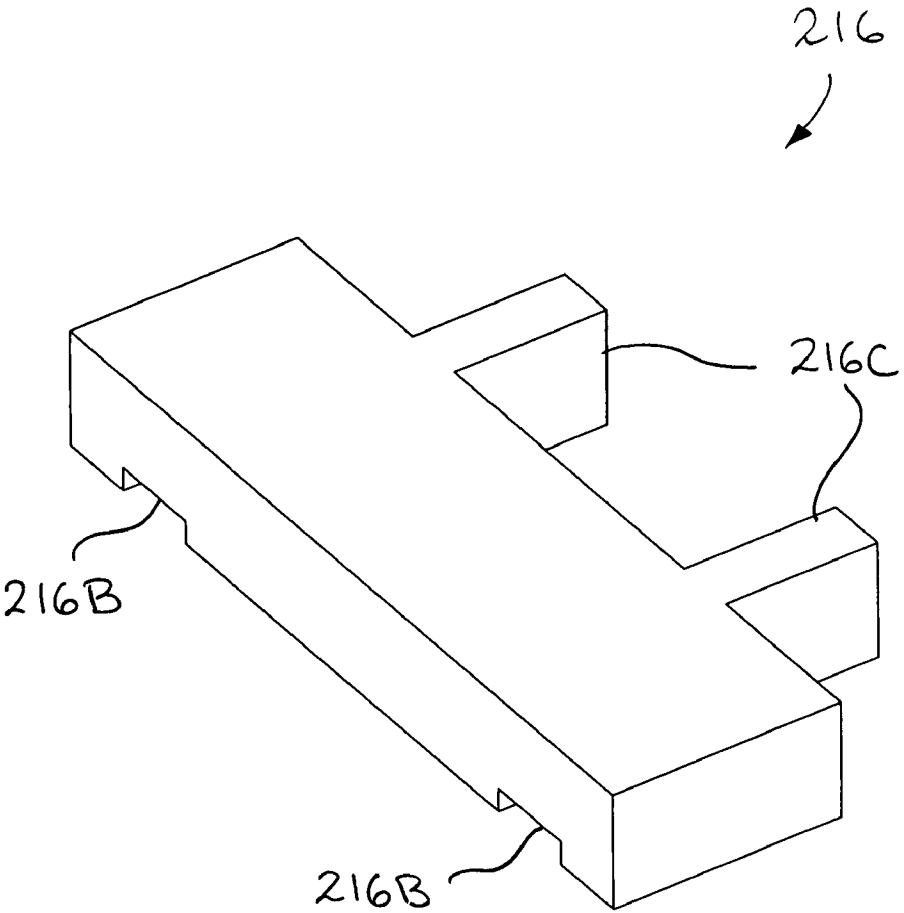
FIG. 19 is a front bottom perspective view of the first part of the pulling assembly shown in FIG. 18.
Figure 20:
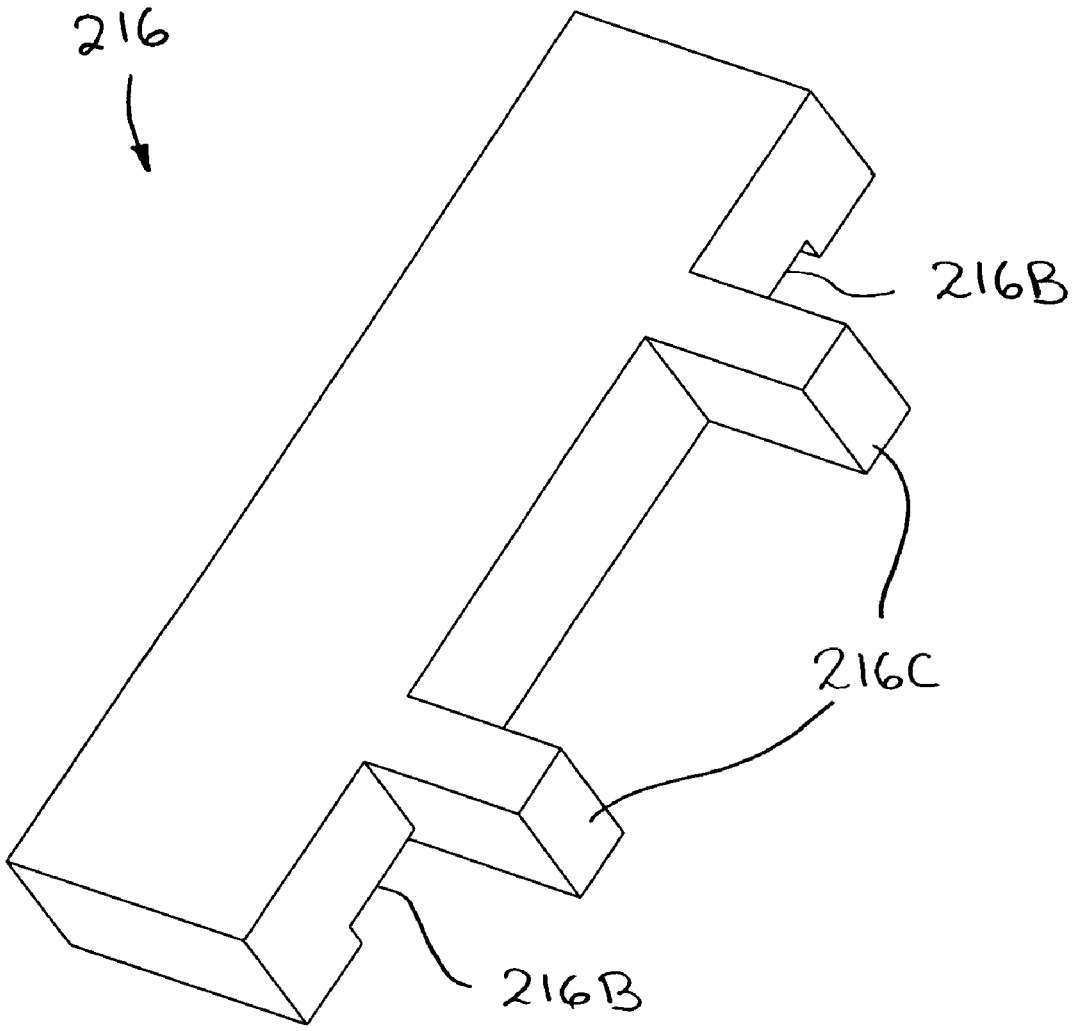
FIG. 20 is a rear bottom perspective view of the first part of the pulling assembly shown in FIG. 18.

FIGS. 18 to 20 show a first part (216) of a pulling assembly (222) to be installed in the base (212). This first part (216) is the one that will rest on the bottom of the base (212). It comprises a central connection hole (216A), two surface channels (216B), each designed to tightly hold a corresponding spring arm (214), and two front spacers (216C).

FIGS. 19 and 20 show the same first part (216) from the bottom.

Figure 21:
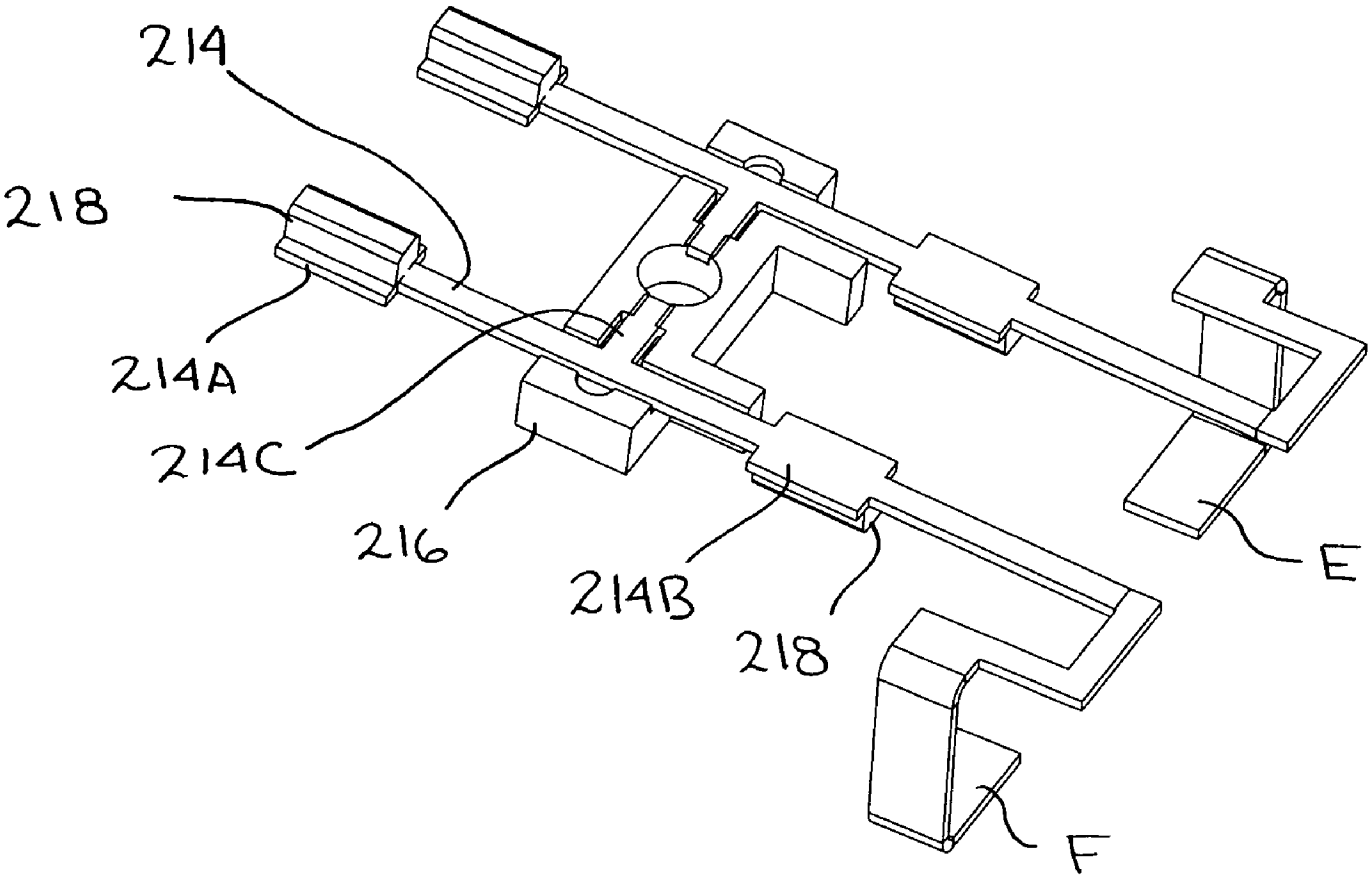
FIG. 21 is a top perspective view showing the addition of the spring arms of FIG. 17 to the first part of the pulling assembly of FIG. 18.

FIG. 21 shows the overall relative position of the first part (216) with reference to the spring arms (214). It also shows that the contact pads (214A, 214B) are each provided with an electrode (218). These electrodes (218) are used on the top of the contact pads (214A) at the free ends and on the bottom of the intermediary contact pads (214B).

Figure 22:
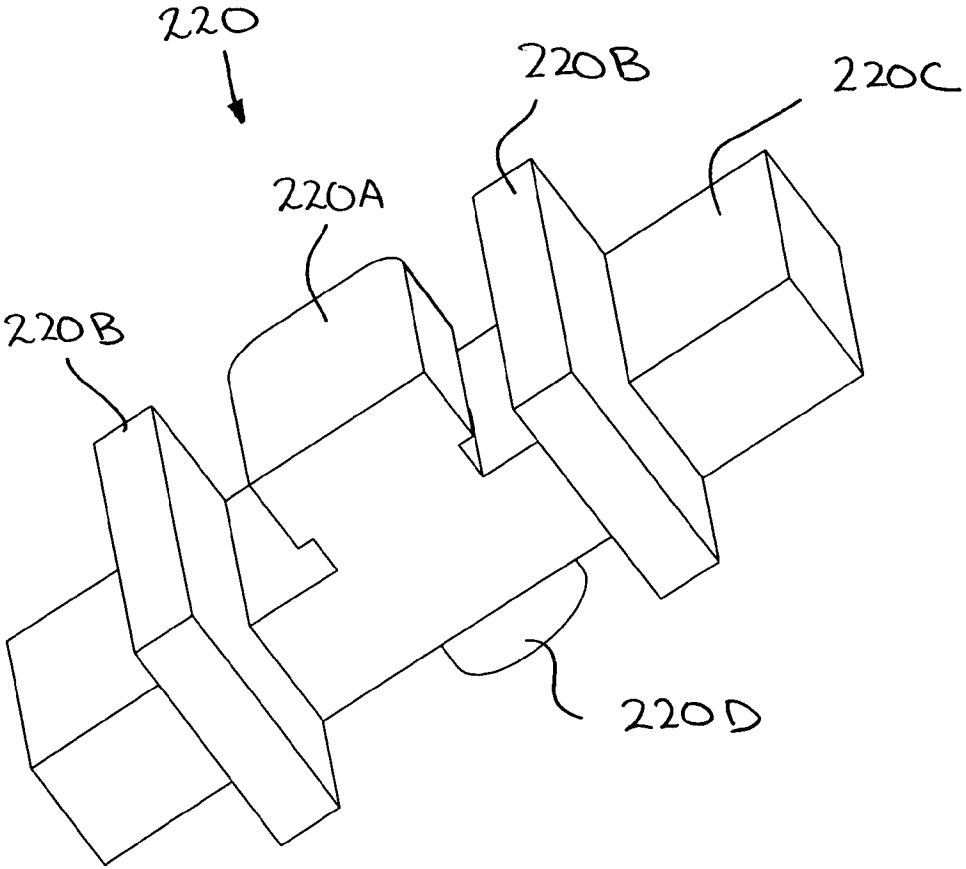
FIG. 22 is a rear top perspective view of a second part of the pulling assembly in the EMR of FIG. 15.
Figure 23:
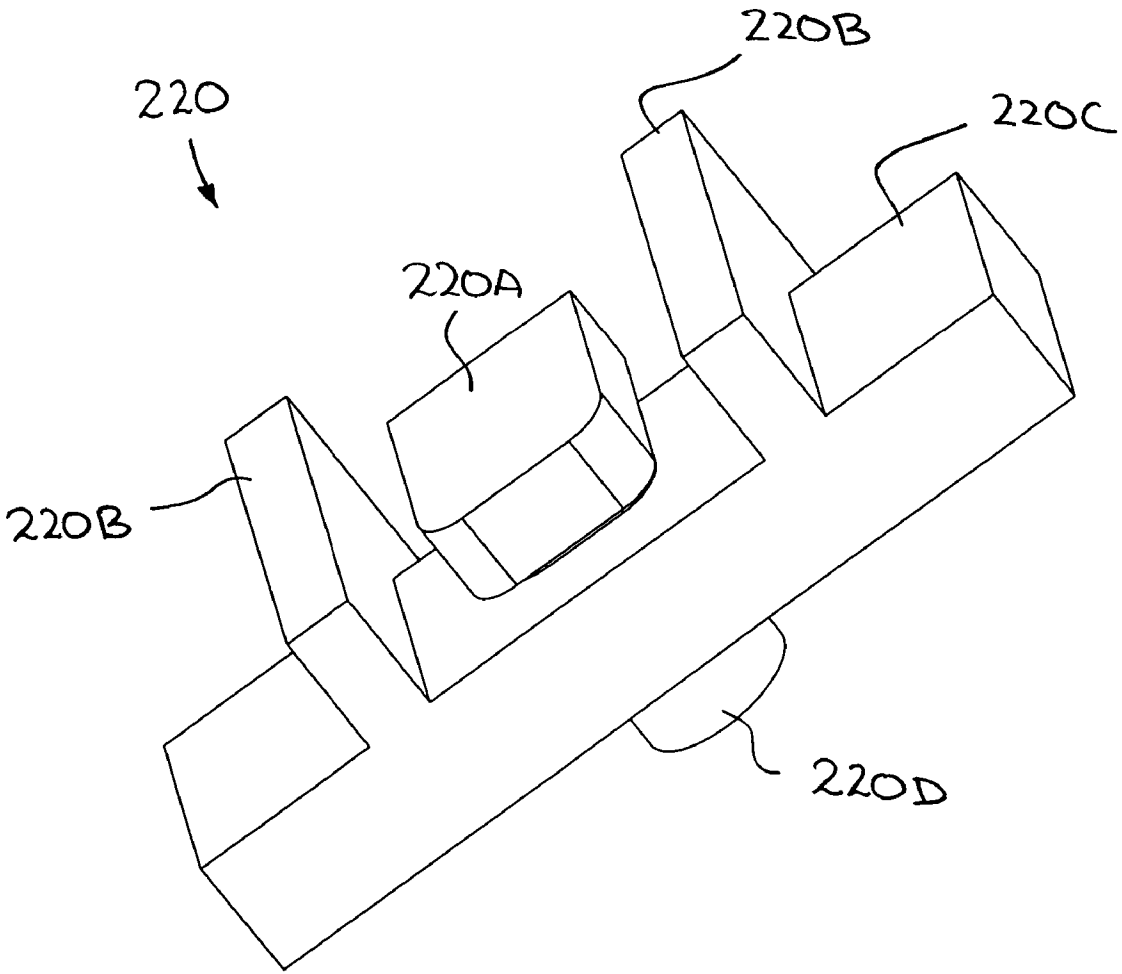
FIG. 23 is a front top perspective view of a second part of the pulling assembly in the EMR of FIG. 15.

FIG. 22 shows a second part (220) of the pulling assembly (222). This second part (220) is designed to be attached tightly over the first part (216) shown in FIGS. 18 to 20. It comprises a central knob (220A), two side flanges (220B), all of which are mounted over an elongated rectangularshaped member (220C). A peg (220D) projects from the opposite side with reference to the knob (220A). FIG. 23 shows the second part (220) from the opposite side.

Figure 24:
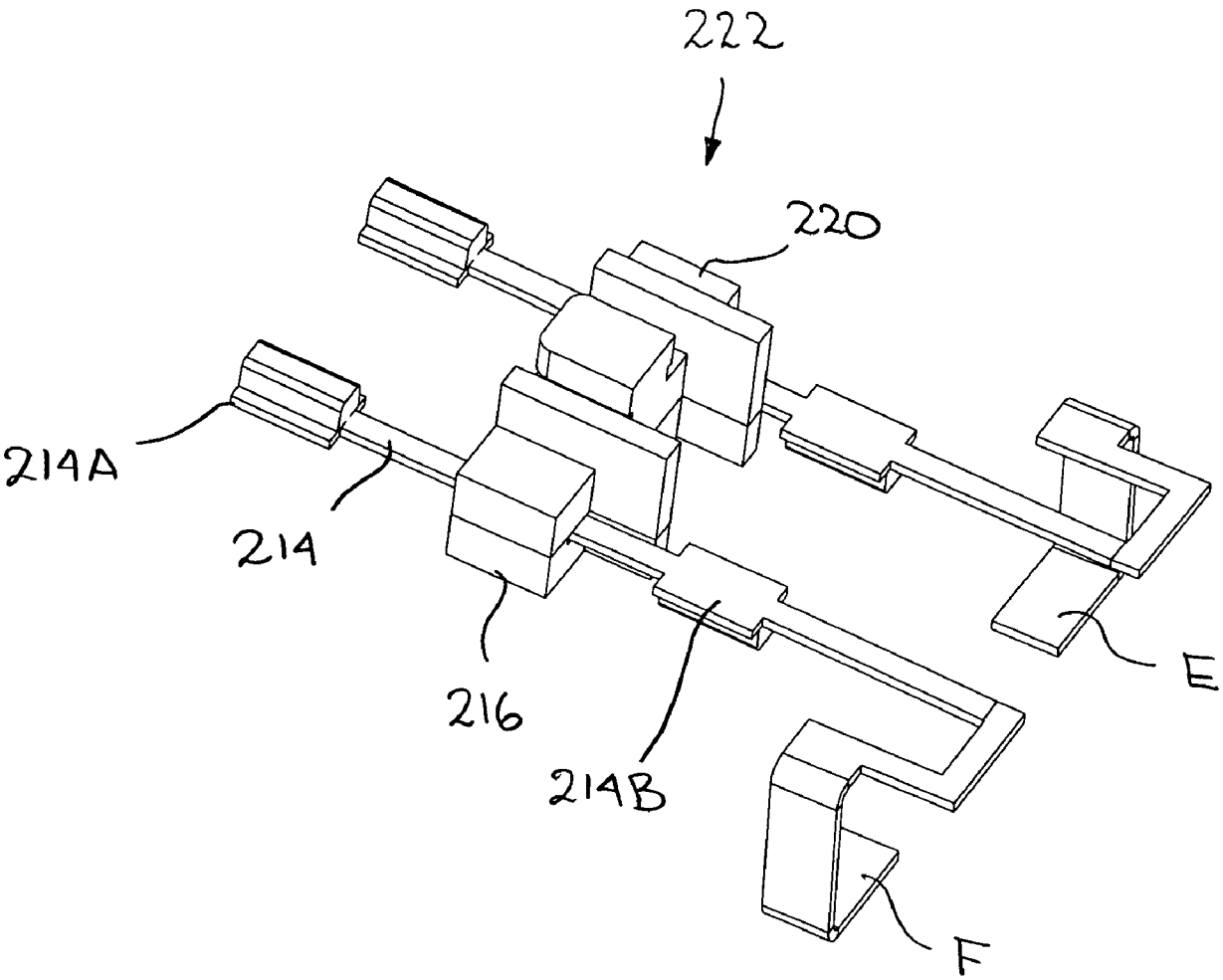
FIG. 24 is a top perspective view showing the second part of the pulling assembly being added to what is shown in FIG. 21.

FIG. 24 shows the first part (216) and the second part (220) of the completed pulling assembly (222) provided over the spring arms (214). This pulling assembly (222) is composed of the first part (216) and the second part (220). Both parts (216, 220) are rigidly connected one over the other, using glue or any other appropriate means. As can be seen, there are then holding the section of the spring arms (214), between their respective contact pads (214A,214B). It should be noted that it is also possible to mold the pulling assembly (222) in one part.

Figure 25:
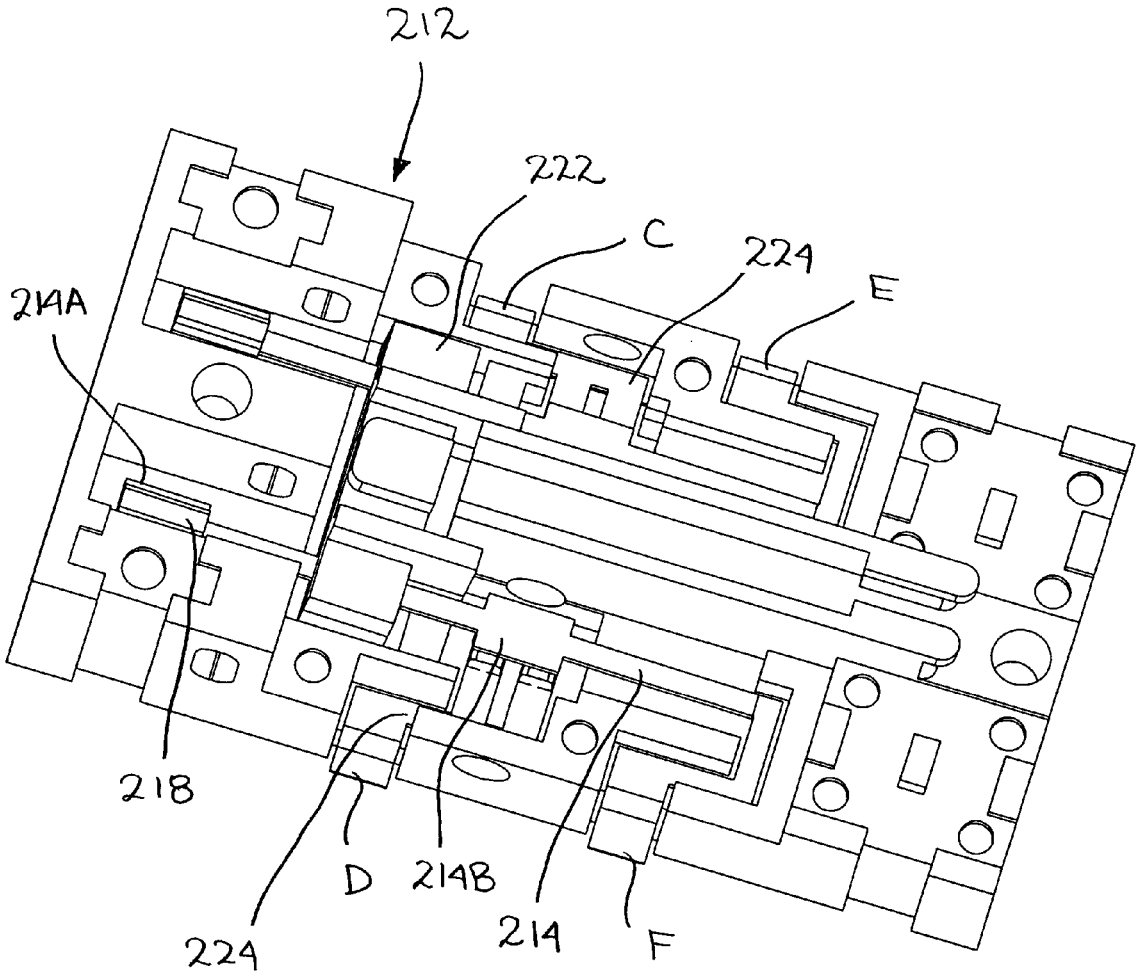
FIG. 25 is a top perspective view of showing the base of FIG. 16 with the elements of FIG. 24 installed therein.
Figure 26:
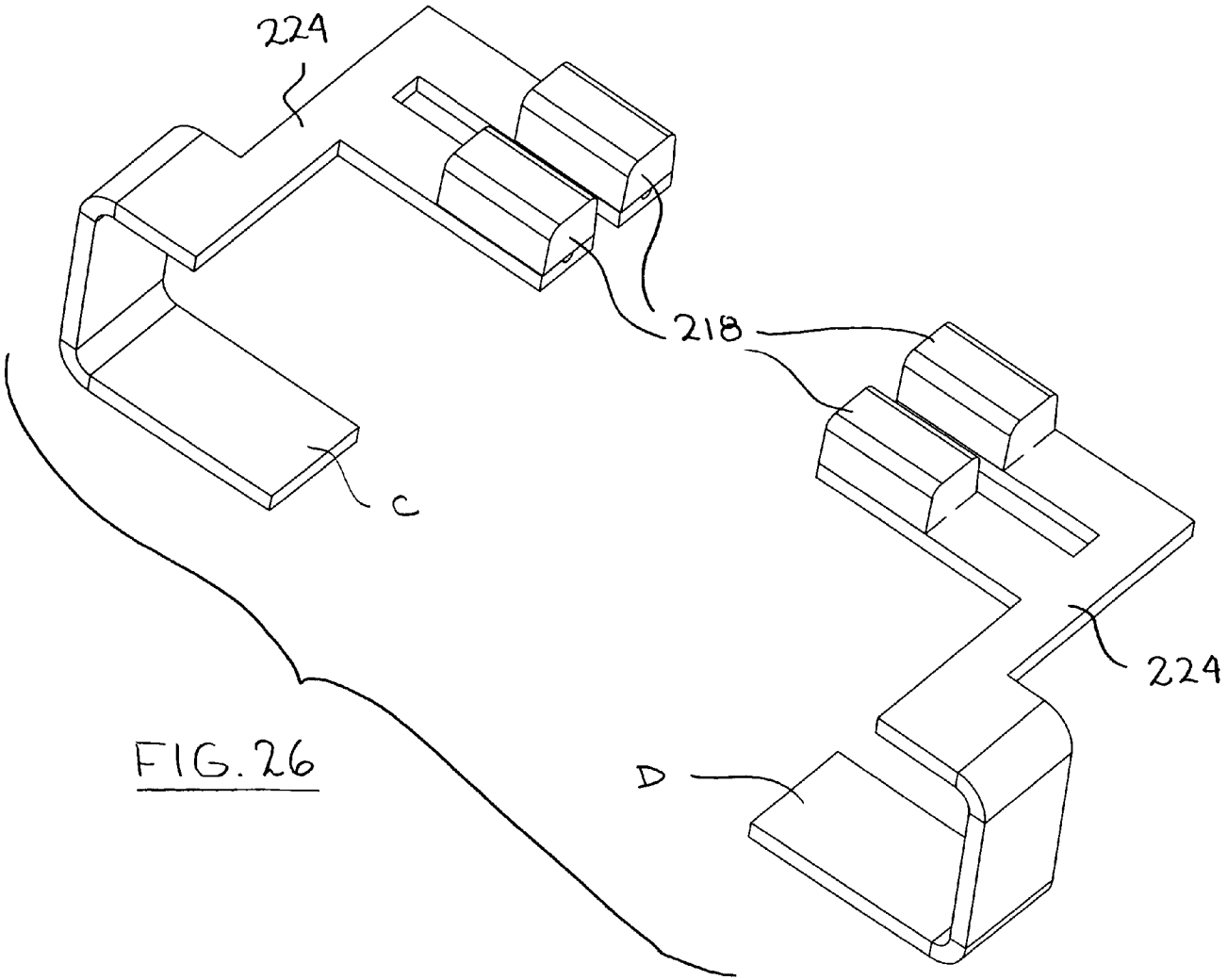
FIG. 26 is a top perspective view of a pair of fork-shaped arms and their electrodes.

FIG. 25 shows the spring arms (214) and the pulling assembly (222) as installed in the base (212). FIG. 25 also shows pins C and D as installed in the base. Each of these pins is connected to a small fork-shaped arm (224). Each arm (224) is provided with two electrodes (218) in the illustrated embodiment. FIG. 26 shows these arms (224) alone.

Referring back to FIG. 25, one can see that the electrodes (218) of each fork-shaped arm (224) are in registry with a transversally disposed electrode (218) attached to one of their contact pads (214B) of a corresponding arm (214). It should be noted that the fork-shaped arm (224) can be replaced by an arm with a single electrode (218). The purpose of having two electrodes (218) on the same arm (224) is that the upper electrode (218), namely the one attached to the intermediate contact pads (214B), can be designed to touch in sequence the two lower electrodes (218). Over time, sparks between the two electrodes (218) will diminish the conductivity between the upper electrode (218) and the lower electrode (218) being touched the first. The second lower electrode (218) will thus allow that there is always a good electrical contact.

As can be appreciated, the spring arms (214) can be moved by changing the position of the pulling assembly (222). This will determine whether the contact is made by the electrodes (218) on the contact pads (214A) at the end of the spring arms (214), or by those of the intermediary contact pads (214B).

Figure 27:
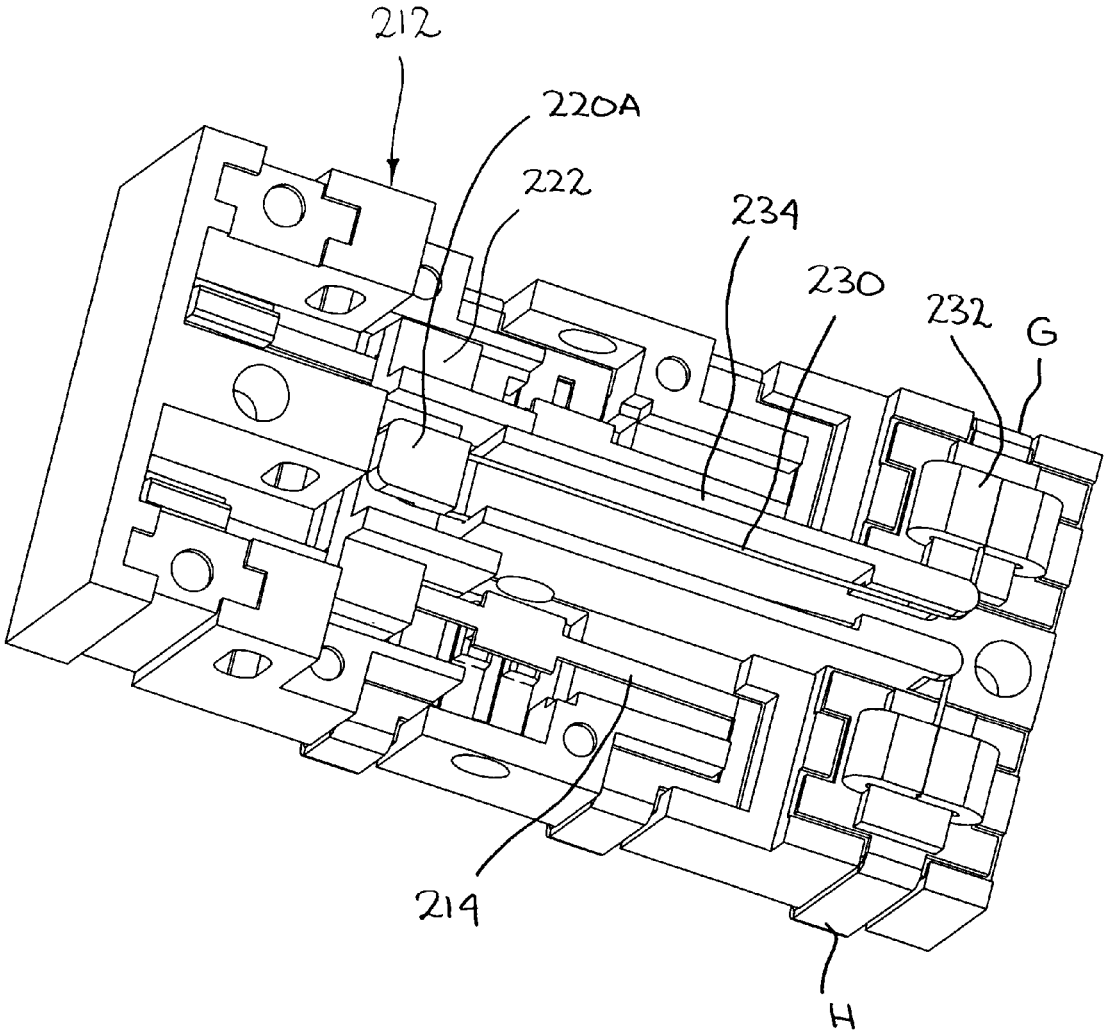
FIG. 27 is a top perspective view of pins G and H, with their corresponding crimps, as used in the EMR of FIG. 15.
Figure 28:
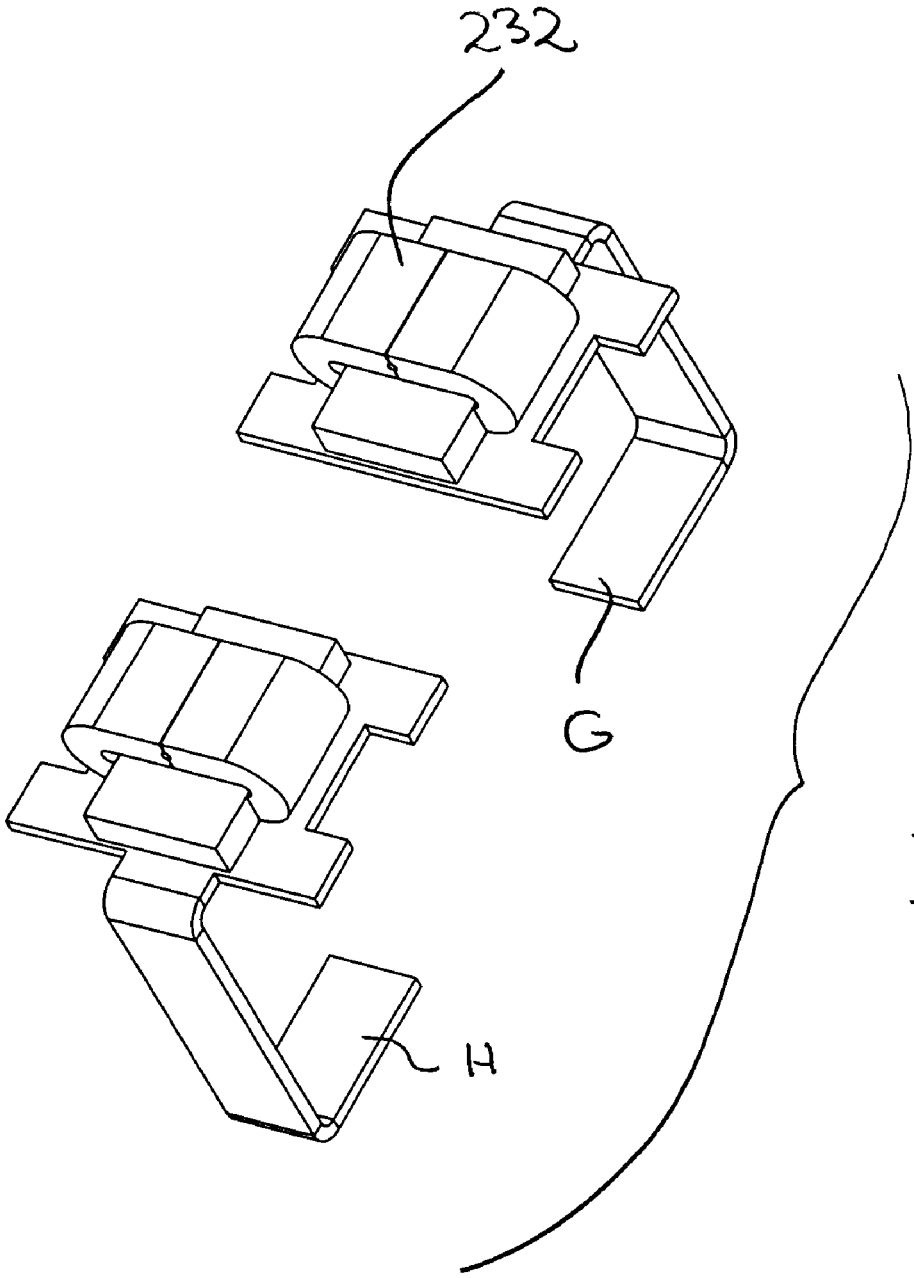
FIG. 28 is a top perspective view of the base and most of the pulling assembly.

The pulling assembly (222) is movable between two positions, one being the first position and the other being the second position. FIG. 27 shows the complete pulling assembly (222) of the EMR (200) in the base (212) thereof. It uses a heat-shrinking wire (230), for instance a wire made of a Nickel-Titanium alloy, extending between two fixed locations and the pulling assembly (222). In the illustrated embodiment, the wire (230) is held by crimps (232) at both ends. The crimps (232) are respectively electrically connected to pins G and H. A set of spaced-apart longitudinal walls (234) allows changing the orientation of the wire (230) from a transverse direction to a longitudinal direction. The longitudinal walls (234) also allow increasing the electric insulation between the heat shrinkable wire (230) and the spring arms (214) on both side. The wire (230) then goes around the knob (220A) of the second and upper part (220) of the pulling assembly (222). FIG. 28 is an enlarged view of the crimps (232) and the corresponding pins (G, H).

In use, applying a control voltage between pins G and H heats the heat-shrinking wire (230), thereby reducing its length. This pulls the pulling assembly (222) and forces it to move upwards to the second position.

It should be noted that the exact configuration of the wire (230) may differ from what is shown herein, depending on the needs. For instance, one can simply provide a straight wire extending directly between the pulling assembly and a corresponding crimp.

Figure 29:
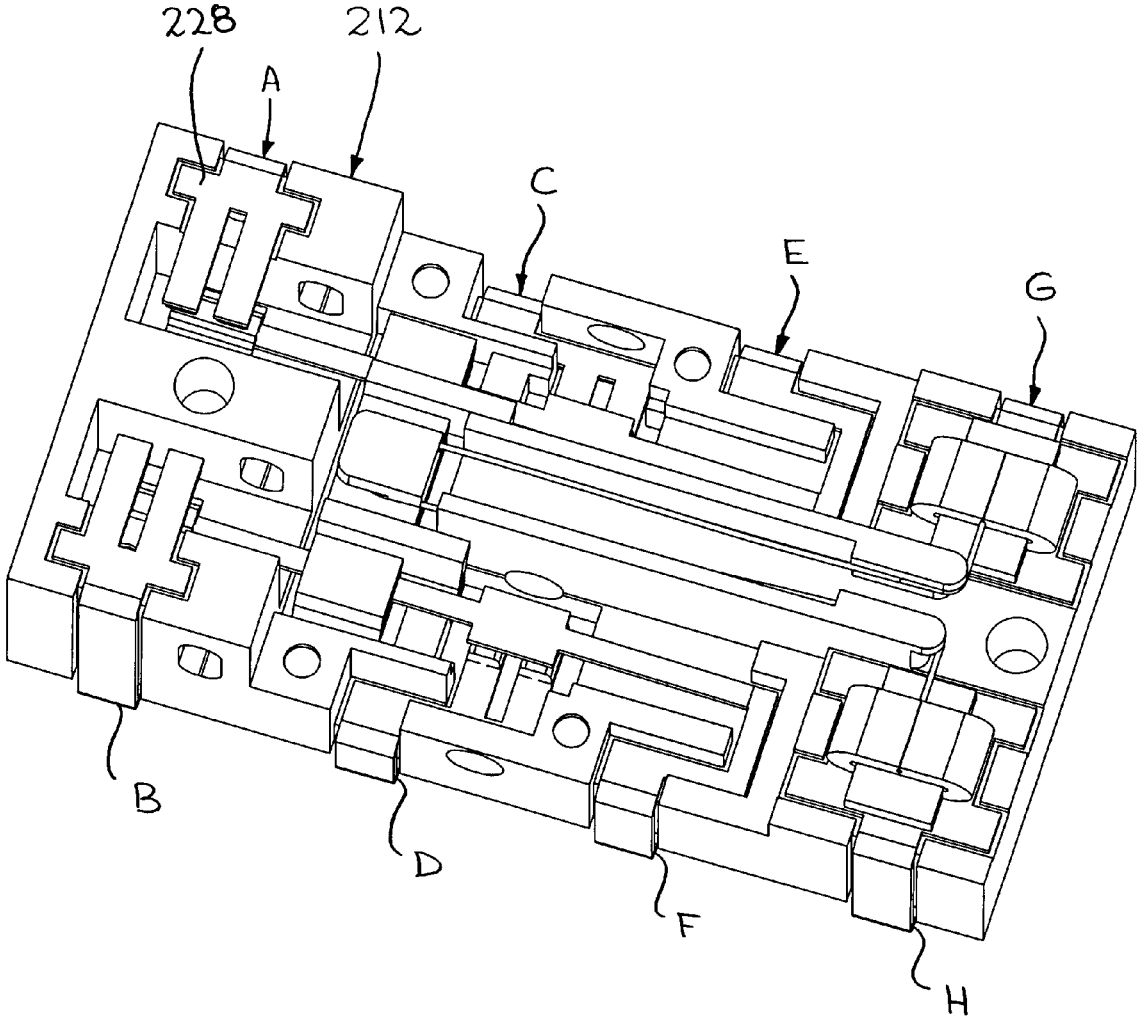
FIG. 29 is a top perspective view showing the addition of what is shown in FIG. 27 to what is shown in FIG. 28.
Figure 30:
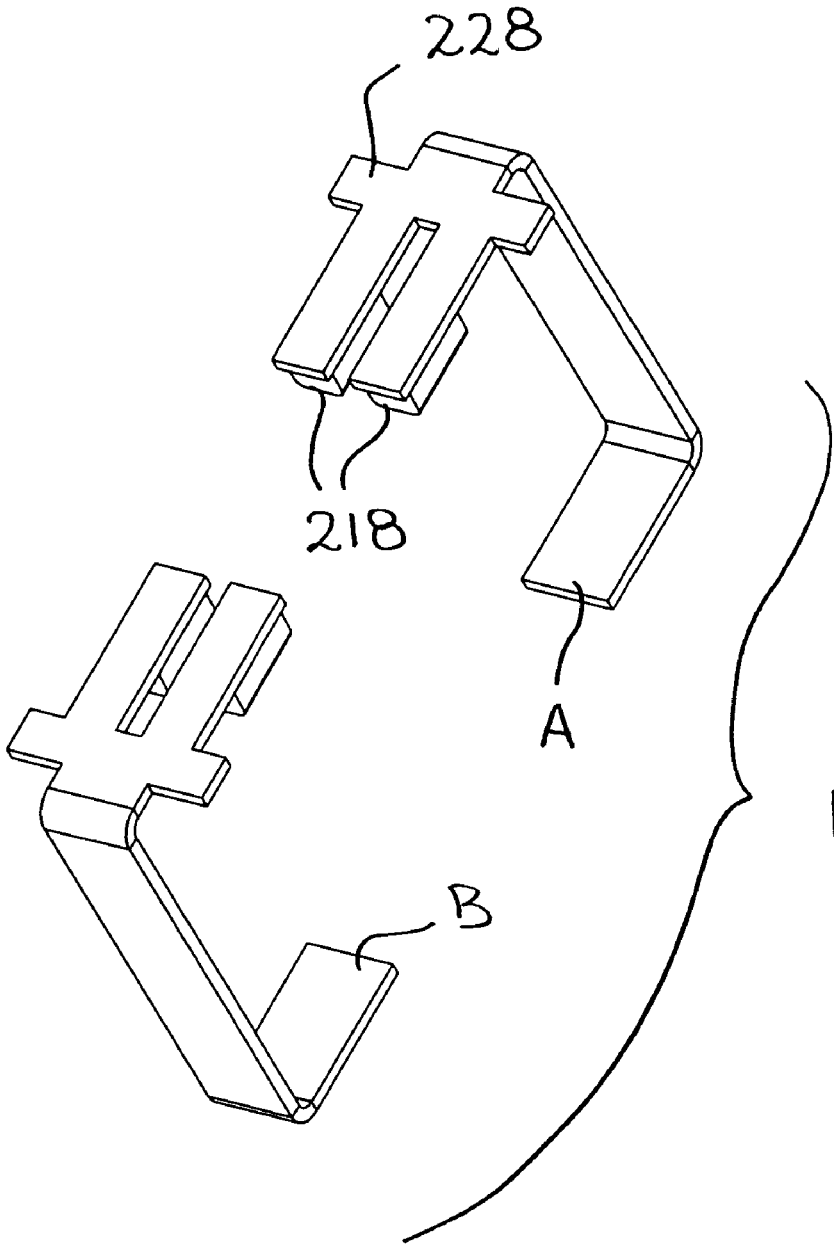
FIG. 30 is a top perspective view of pins A and B.

FIG. 29 shows the pins A and B, both provided with corresponding fork-shaped arms (228), installed on the base (212). FIG. 30 individually shows these parts and their electrodes. In the second position the electrodes (218) located on the pad (214A) of both side of the spring arm (214) make contact with the electrodes (218) located on the arms (228) extending from pins A and B.

Figure 31:
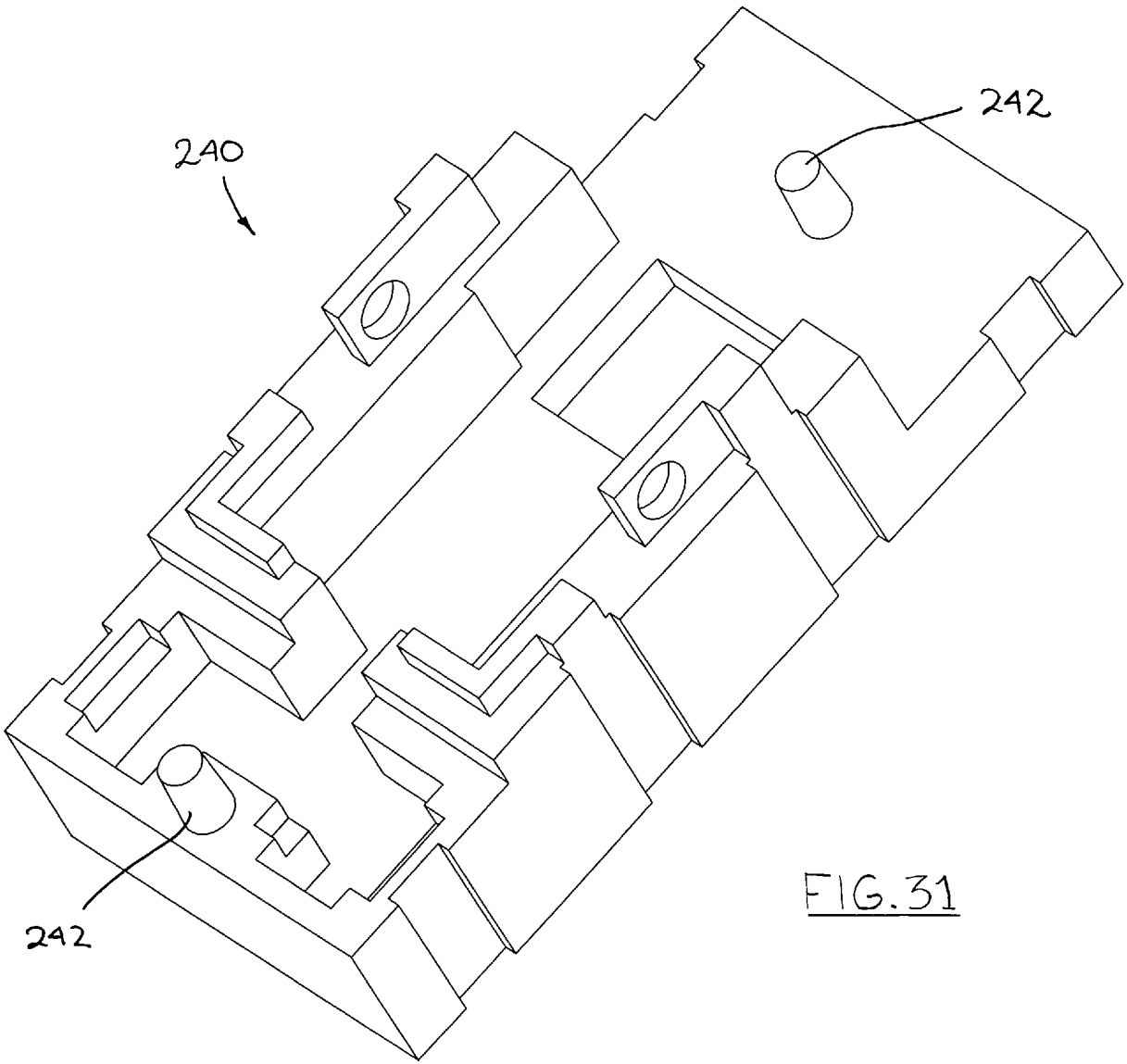
FIG. 31 is a right bottom perspective view of the upper cover used in the EMR of FIG. 15.
Figure 32:
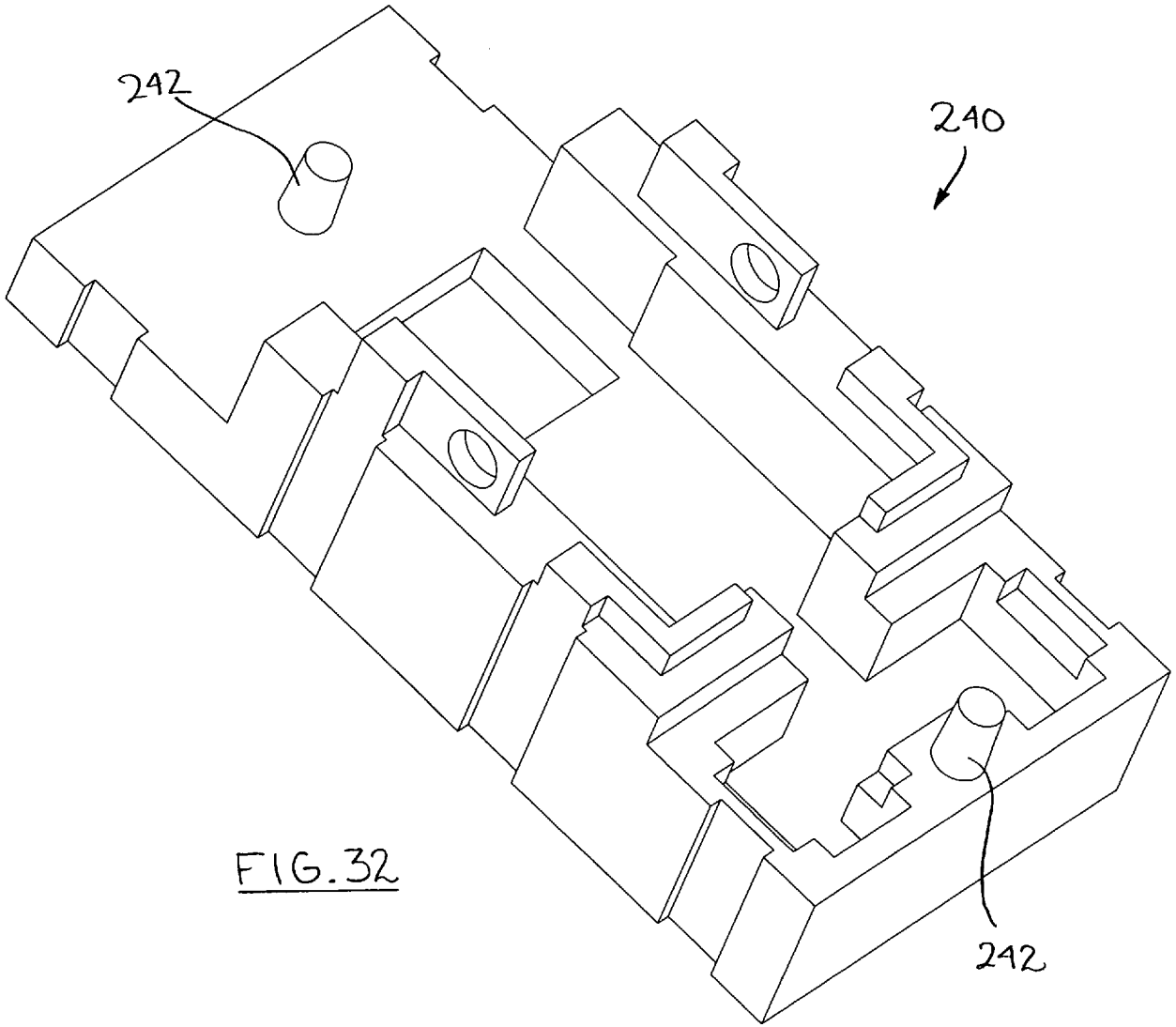
FIG. 32 is a left bottom perspective view of the upper cover of FIG. 31.
Figure 33:
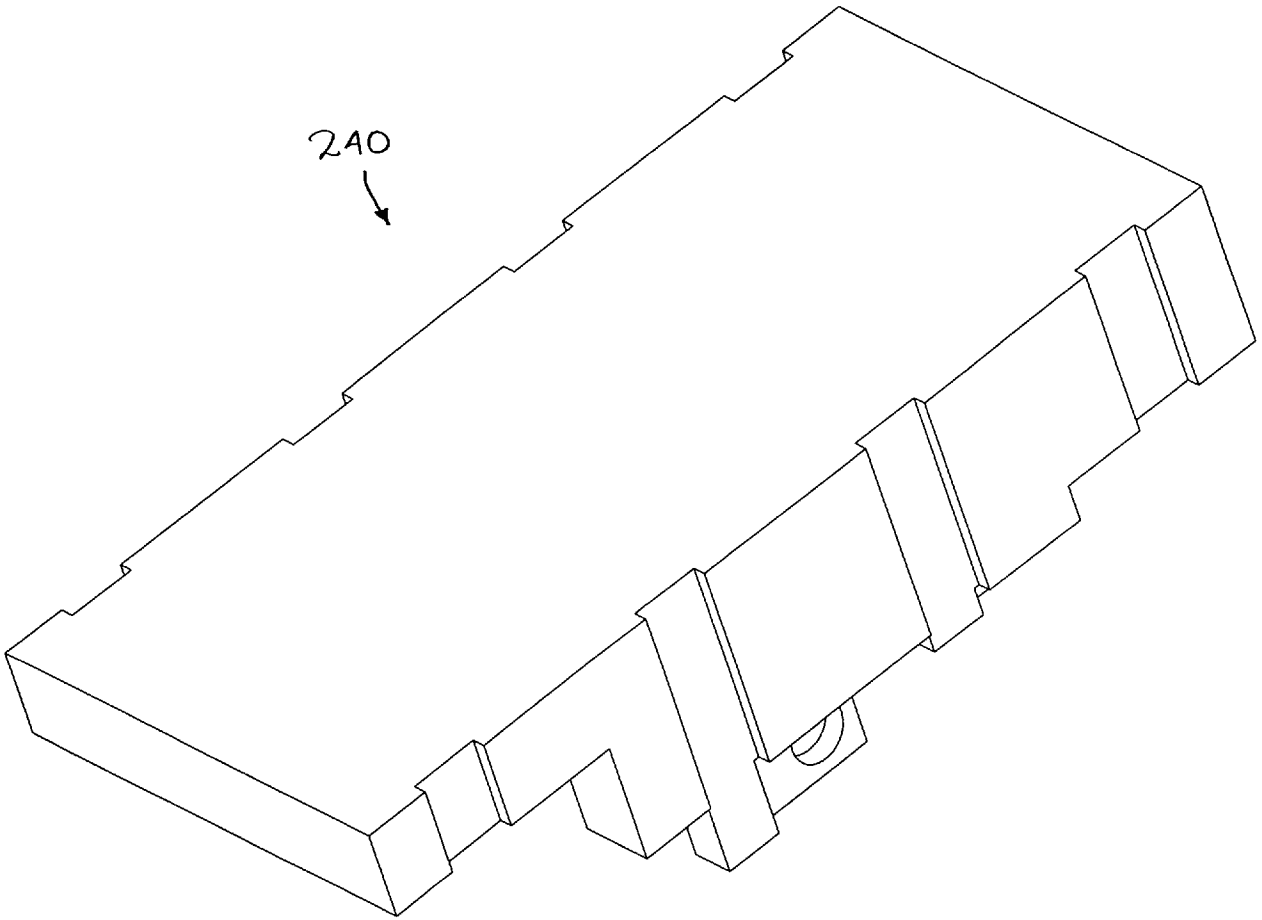
FIG. 33 is a top perspective view of the upper cover of FIG. 31.

FIGS. 31 to 33 show the upper cover (240). It comprises a set of pins (242) which fit into corresponding holes in the base (212). The upper cover (240) has walls and recesses which fit perfectly on the base (212). The upper cover (240) is also designed to maintain in place the pins and other elements once installed on the base (212).

Figure 34:
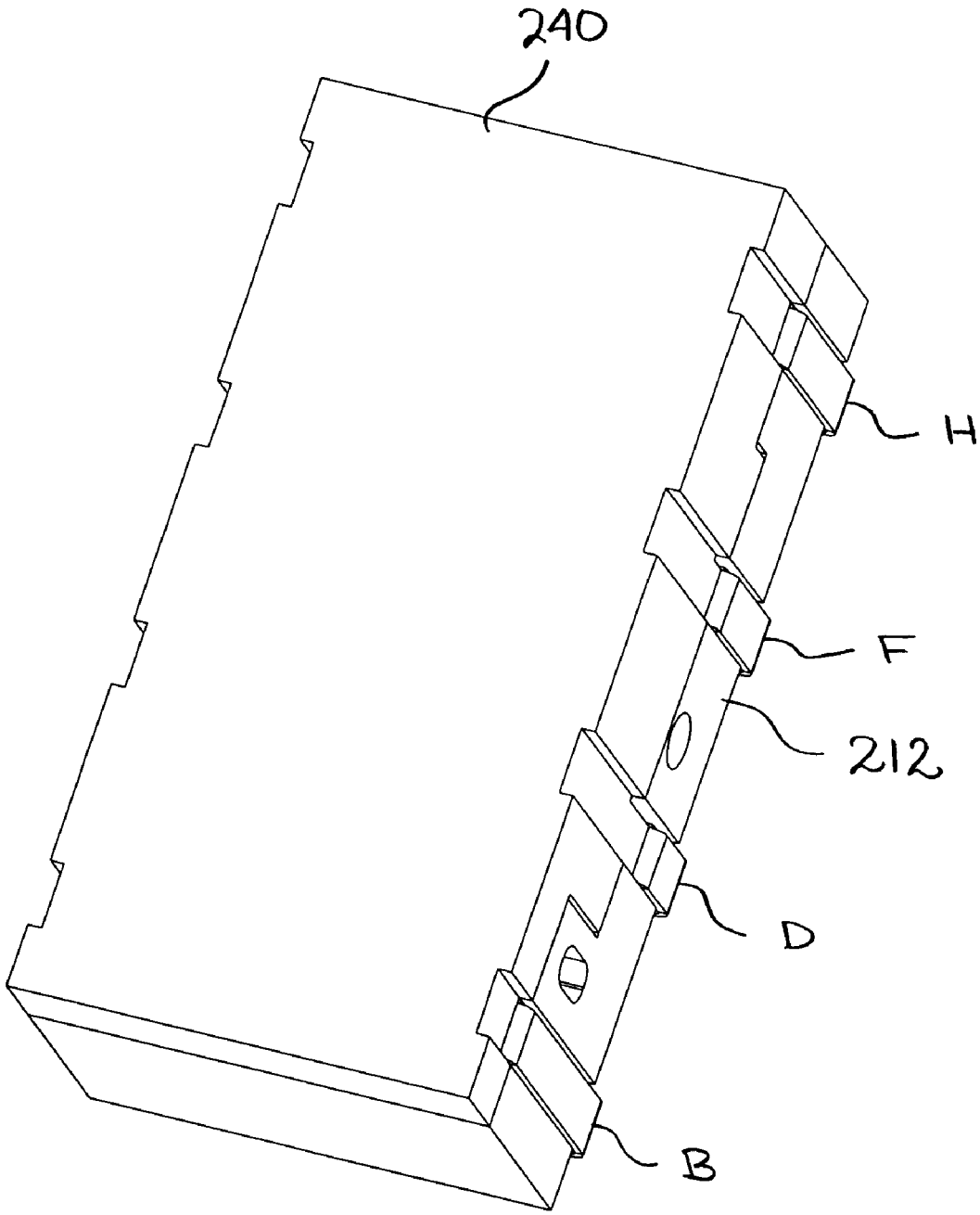
FIG. 34 is a top perspective view of the combination of what is shown in FIGS. 29 and 33.
Figure 35:
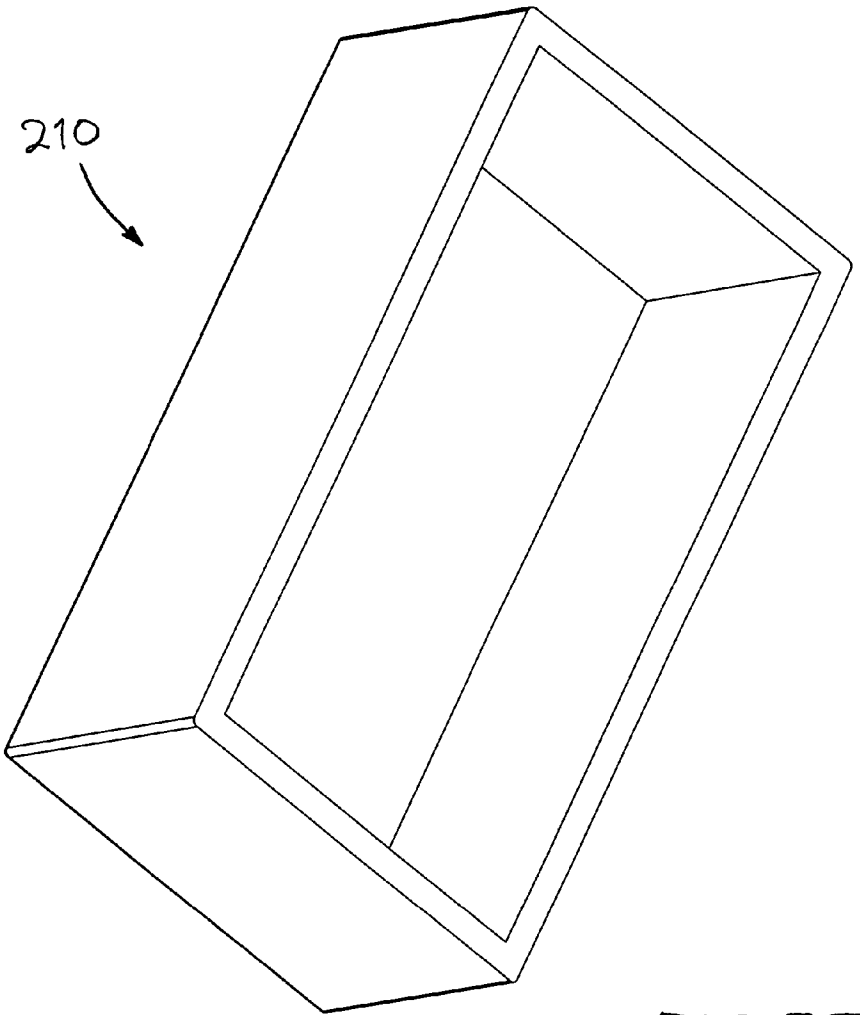
FIG. 35 is a bottom perspective view of the protective cap with in the EMR of FIG. 15.

FIG. 34 shows the upper cover (240) over the base (212). Glue or another bonding technique is used to retain the parts together. As aforesaid, a manufacturing process involving direct plastic injections may also be used.

Finally, the protective cap (210) is installed over the upper cover (240) for an optimal protection of the EMR (200). The protective cap (210) is individually shown in FIG. 35.

Second Alternative Model

A second alternative model is illustrated in FIGS. 36 to 43. The illustrated EMR (300) also has 8 pins. Pins A and B form a first pair of output terminals. Pins C and D form a second pair of output terminals. Pins E and F form a pair of input terminals. The EMR (300) allows selecting which of the first and second pair of output terminals will be used. The second output pair (pins C and D) is referred to as the normally open contact (NOC) and output pair (pins A and B) as the normally close contact (NCC).

Figure 36:
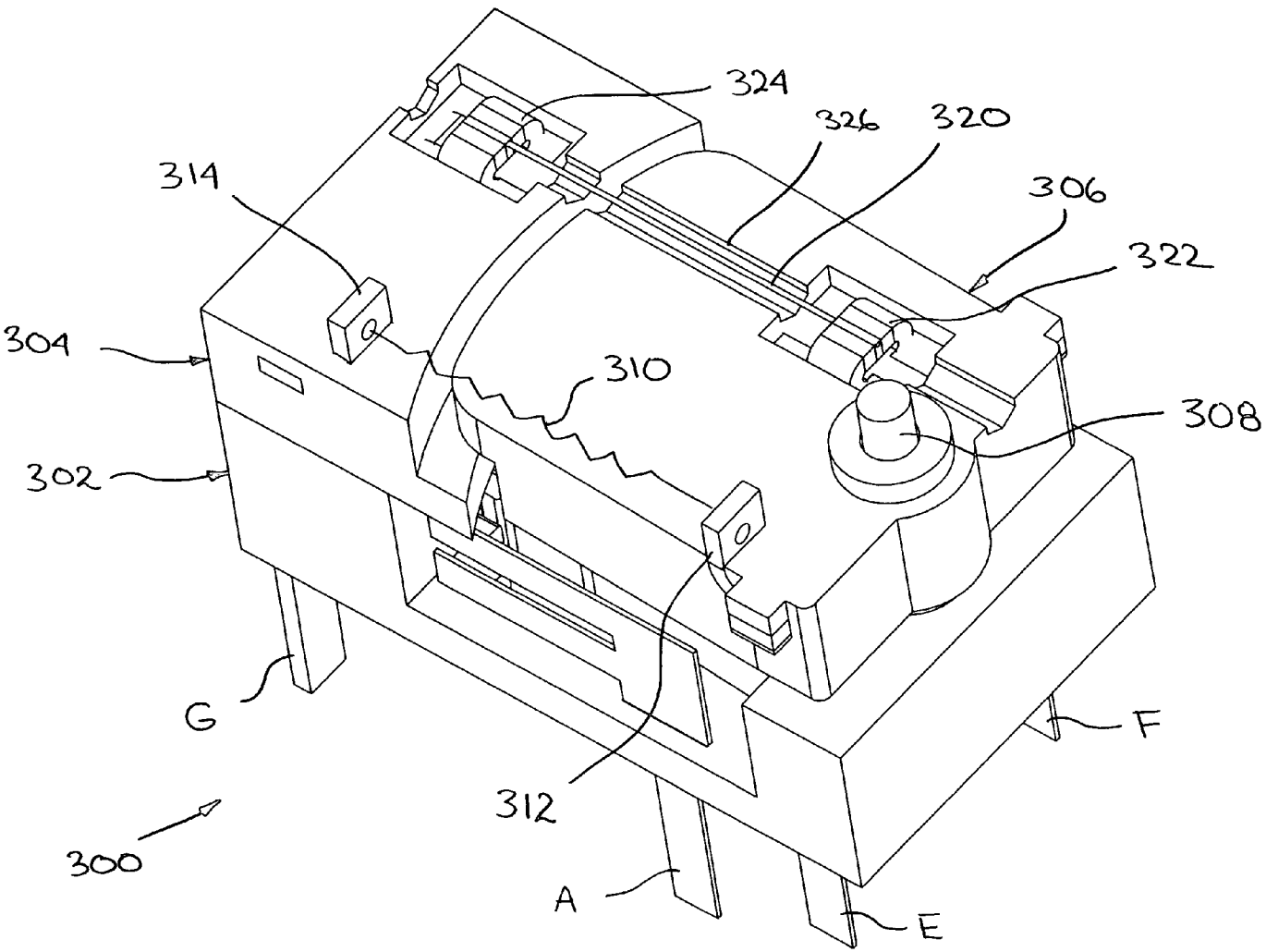
FIG. 36 is a left top perspective view of an example of an assembled EMR in accordance with a possible alternative embodiment.
Figure 37:
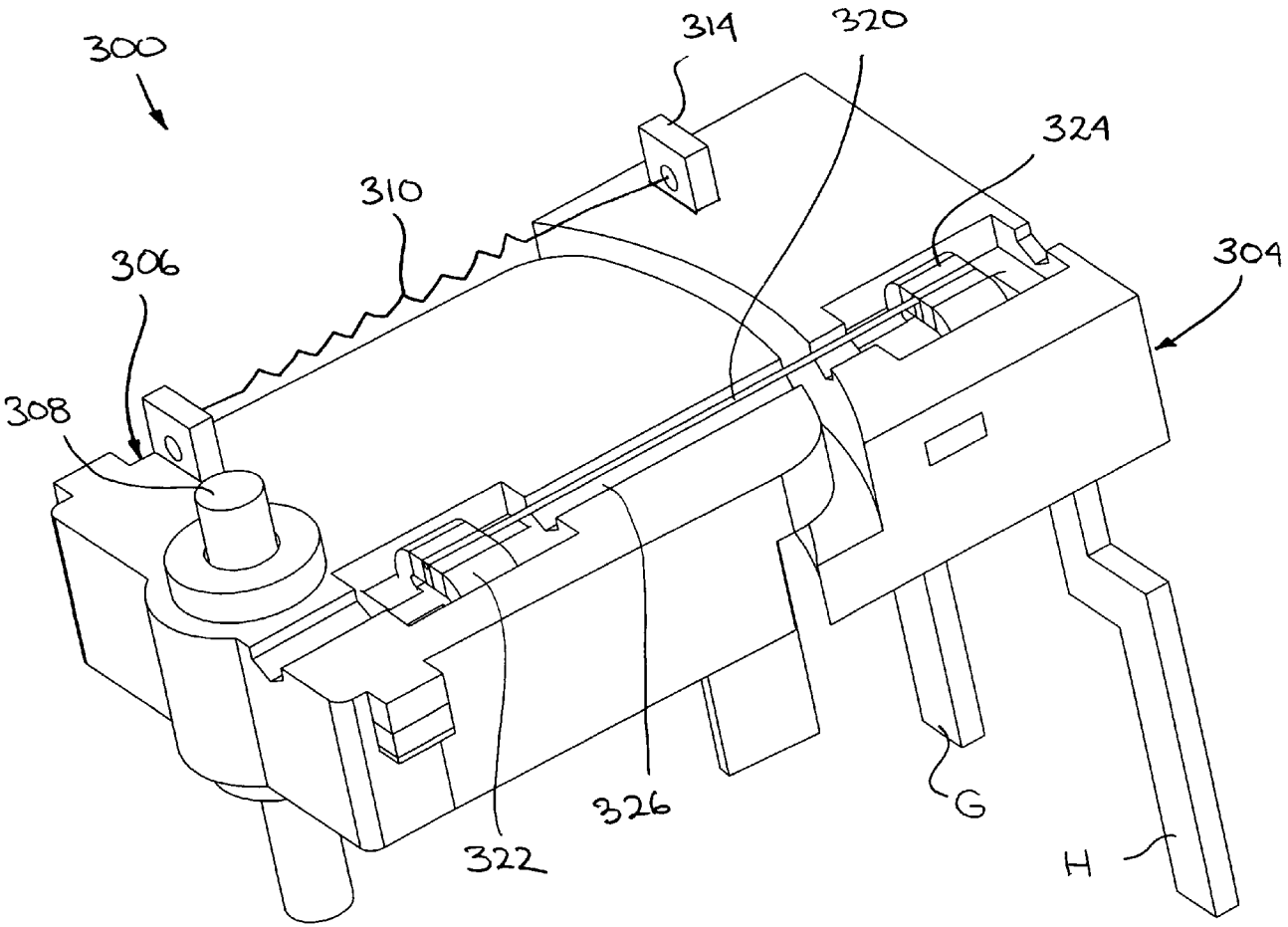
FIG. 37 is a right perspective view similar to FIG. 36, showing the EMR with base removed.

FIG. 36 shows the assembled EMR (300) without its protective cover. FIG. 37 shows the EMR (300) without its base (302).

Figure 38:
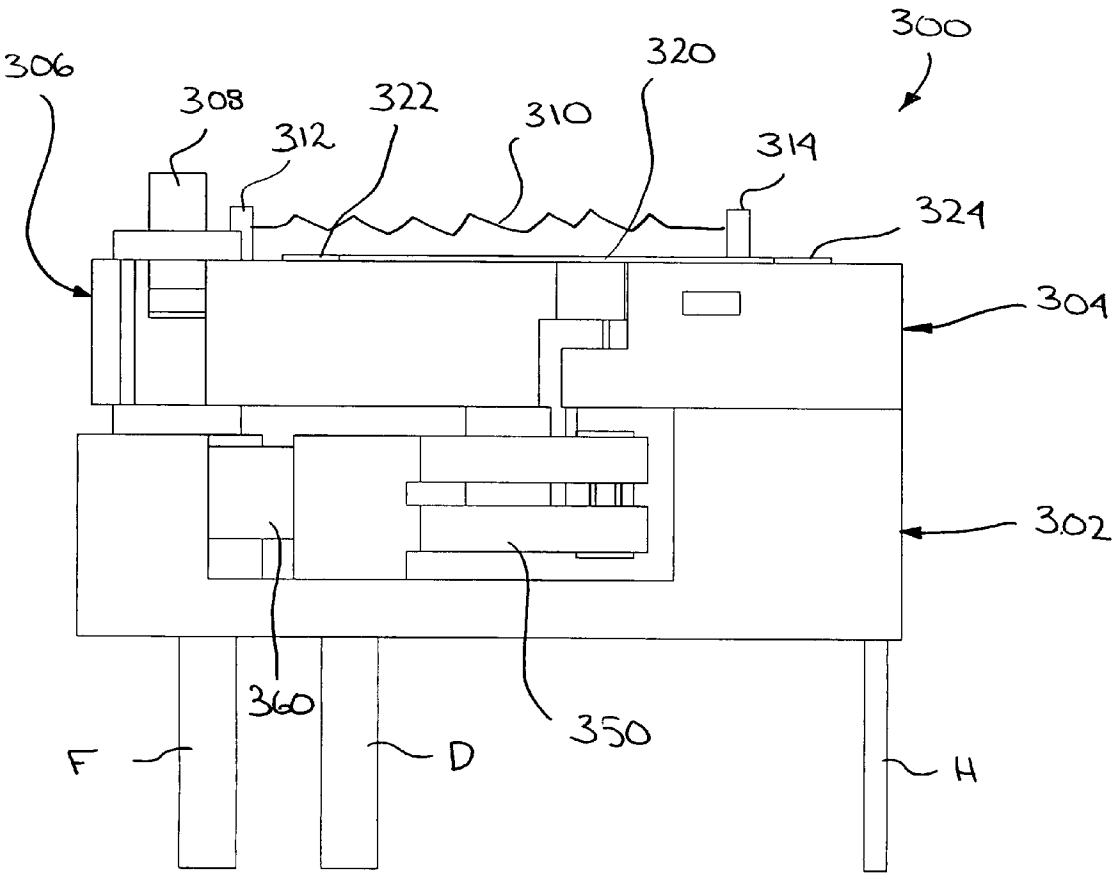
FIG. 38 is a right side view of the EMR of FIG. 36.

FIG. 38 is a side view of the assembled EMR (300) shown in FIG. 36.

Figure 39:
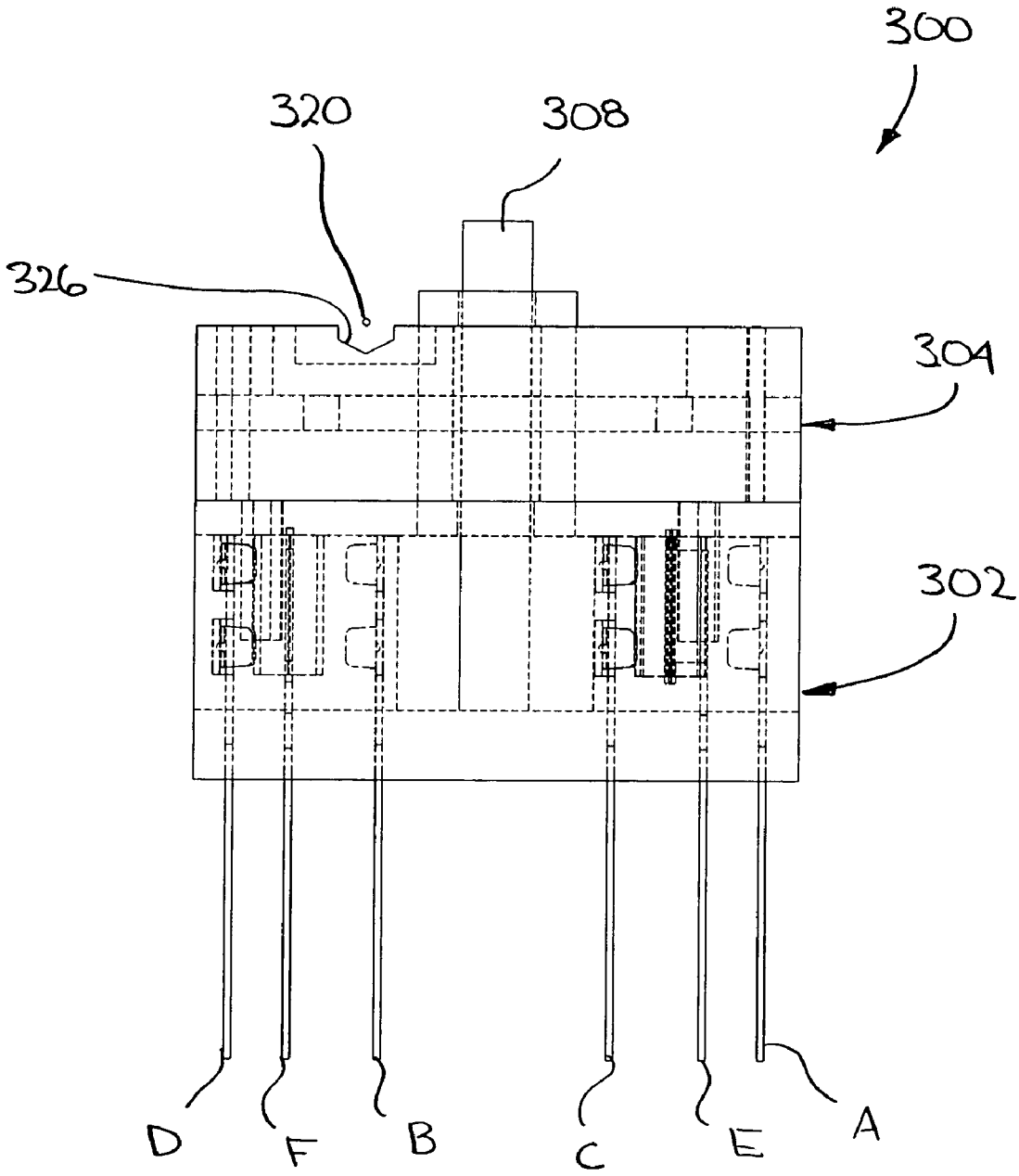
FIG. 39 is a front side view of the EMR of FIG. 36.

FIG. 39 shows the assembled EMR (300) without its protective cover in transparent view.

It should be noted that the same comments concerning possible variations set forth in the explanation of the first model also applies to third model.

The EMR (300) has three main supporting parts, namely the base (302), an upper support (304), which is attached over the base (302), and a pivotable support (306) operatively attached over the base (302) and spaced apart from the upper support (304). The pivotable support (306) is connected to the base (302) using a pin (308) inserted therein. The position of the pivotable support (306) can be changed by activating a pulling assembly which, in this case, only comprises one heat-shrinkable wire (320). A return spring (310), which is only schematically shown in the figures, allows the pivotable support (306) returning to its original position when the heat-shrinkable wire has no current therein. The spring (310) is held between corresponding brackets (312, 314). As shown in FIG. 37, the heat-shrinkable wire (320) is attached using crimps (322, 324). The wire (320) extends in a groove (326) provided on the surface of the pivotable support (306) and the upper support (304). The groove (326) is made large enough to avoid contact between the wire (320) and its surface within the range of motion.

Pin H is electrically connected to the crimp (324). The crimp (322) is electrically connected to pin G using an internal lead made between the crimp (322) and the bracket (312). The pin G is electrically connected to the bracket (314). The circuit is completed by the spring (310), which is also made of an electrical conductive material. This material, however, does not have any heat shrinkable capabilities.

Figure 40:
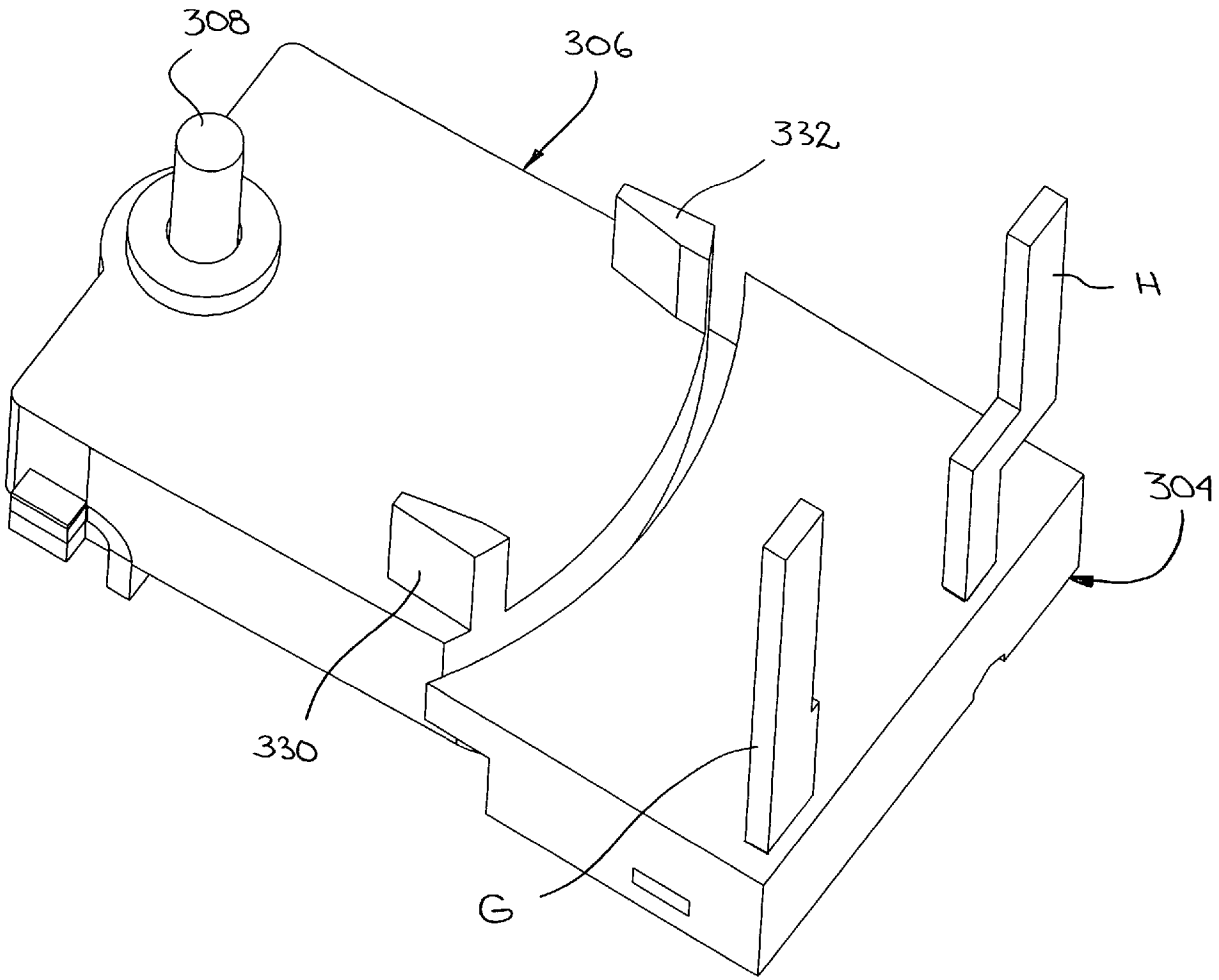
FIG. 40 is a bottom side view of the upper support and the pivotable support used in FIG. 36.

Referring now to FIG. 40, which only shows the bottom of the upper support (304) and of the pivotable support (306), one can see that the parts are shaped to allow the pivot movement between the various parts. FIG. 40 also illustrates the two downwardly projecting flaps (330, 332). The purpose of these flaps will be explained hereafter.

Figure 41:
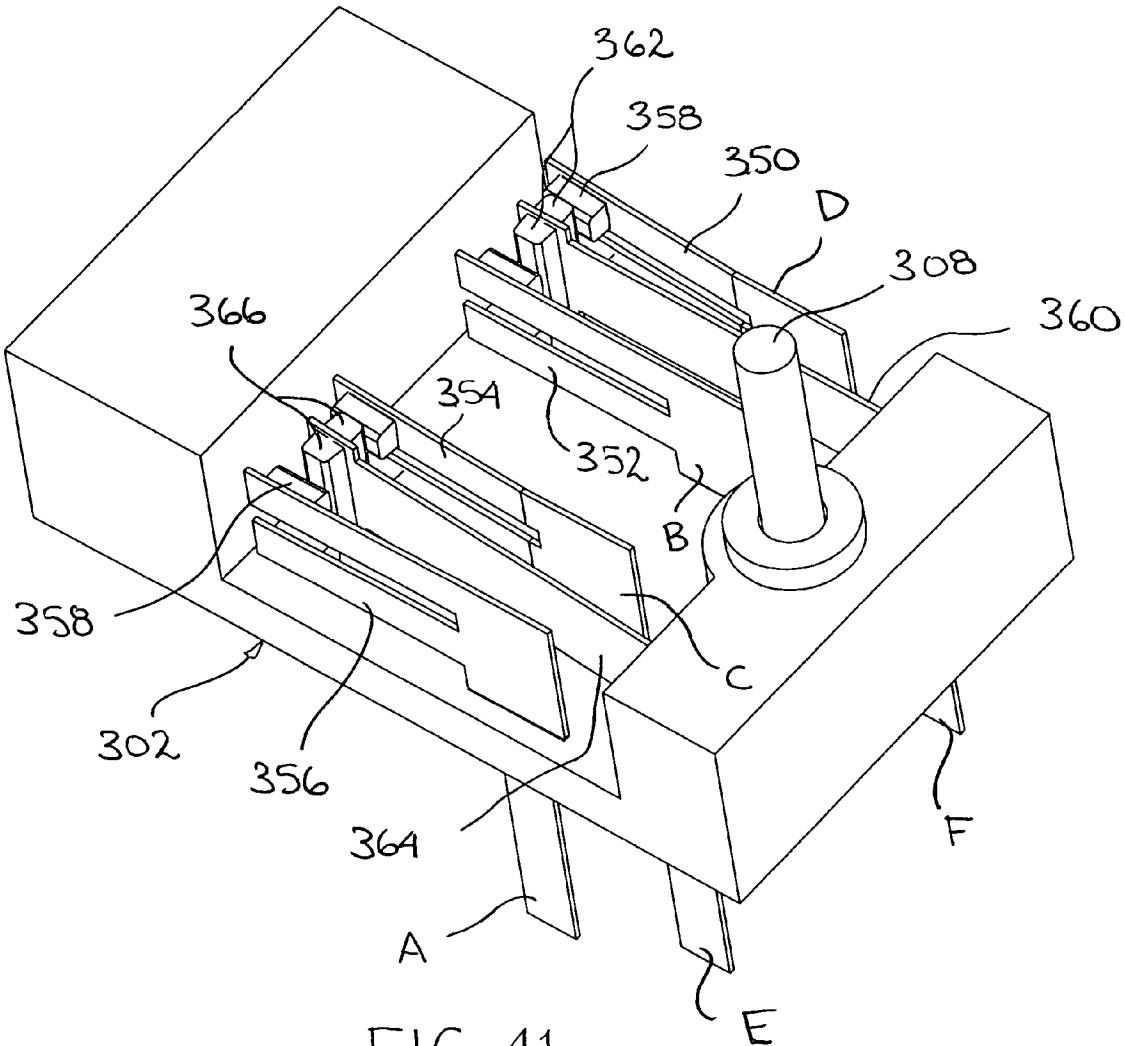
FIG. 41 is a left top perspective view showing the metallic parts inside the base.
Figure 42:
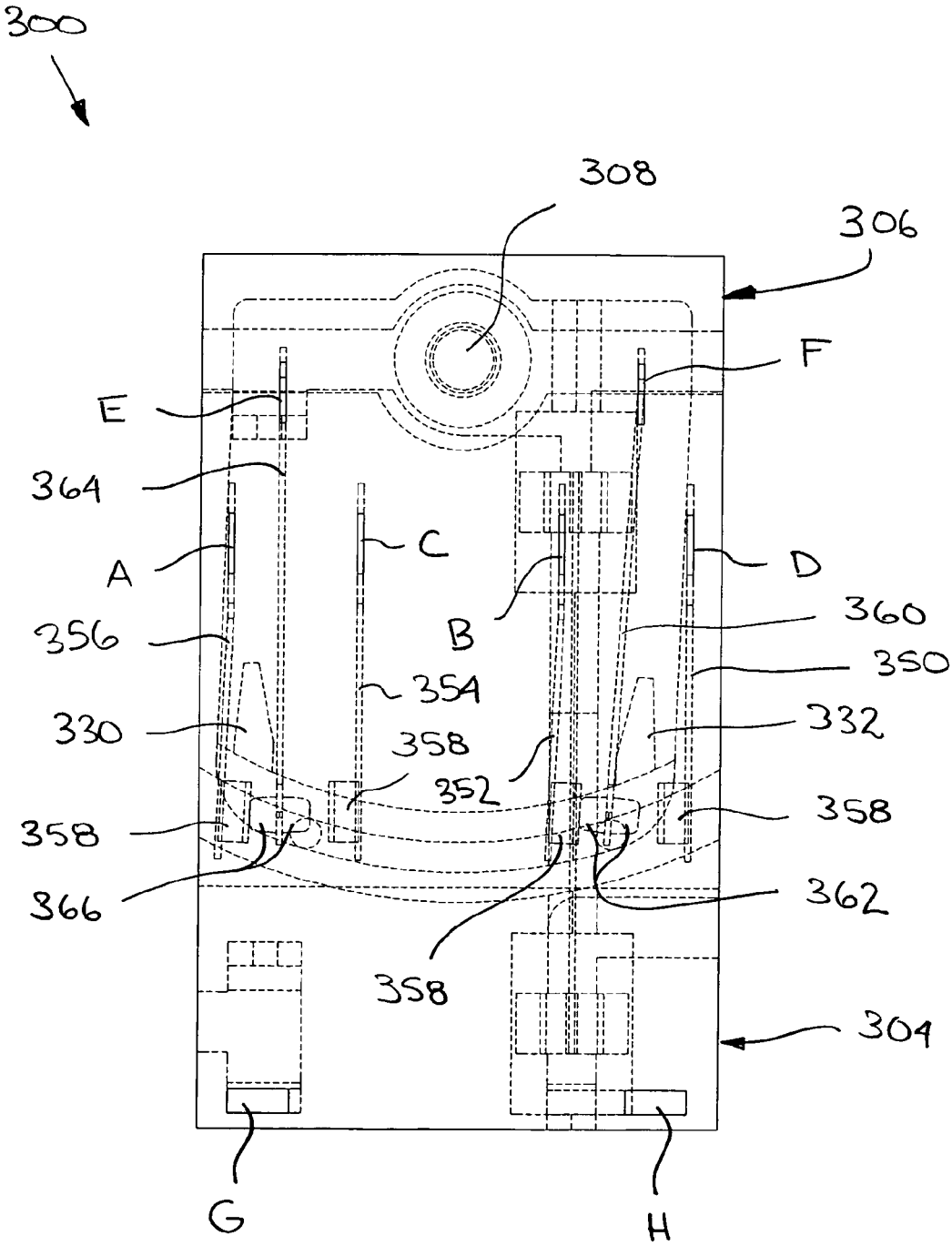
FIG. 42 is a bottom side view of the EMR of FIG. 36, with the EMR set in a first position.
Figure 43:
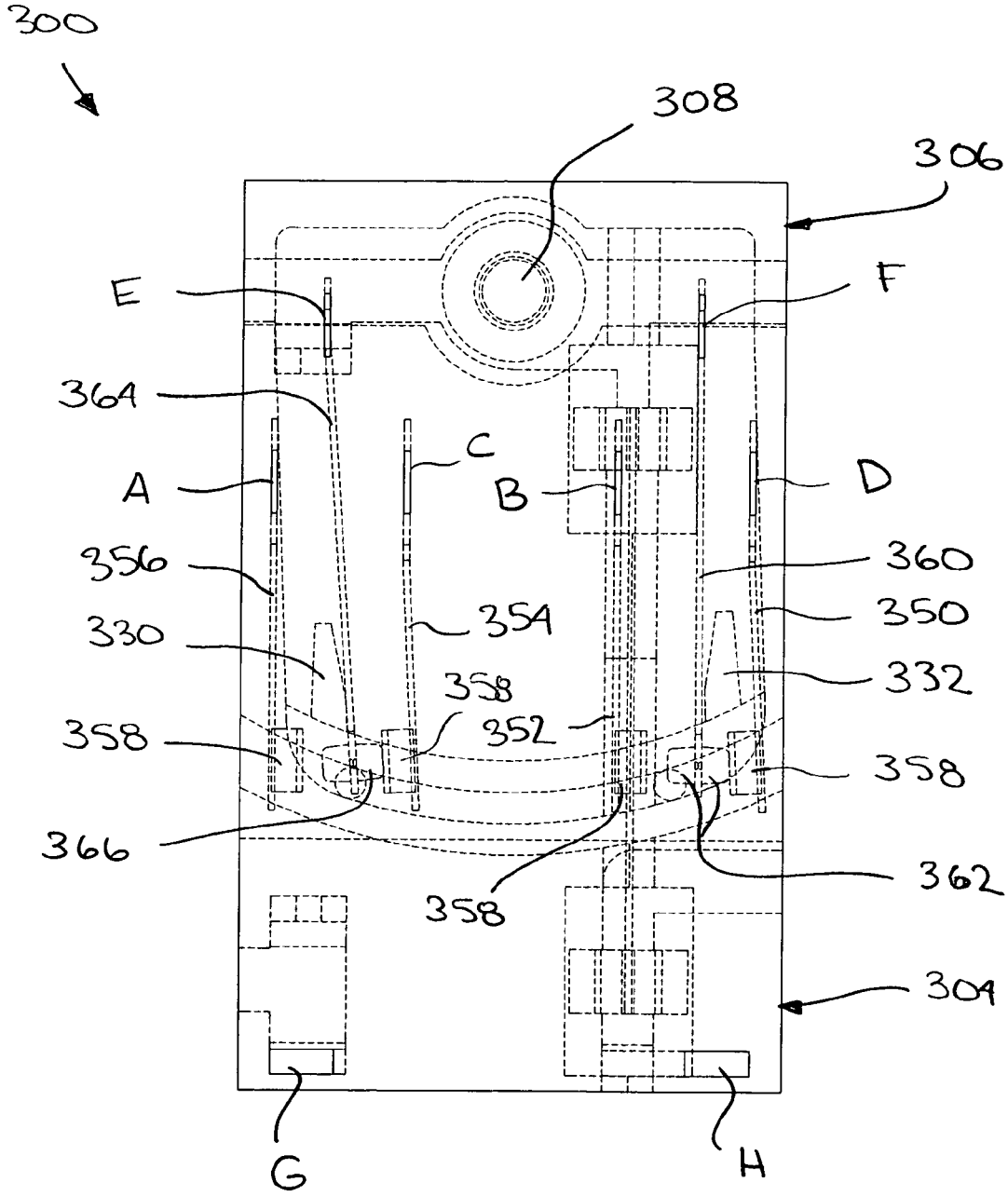
FIG. 43 is a view similar to FIG. 42, with the EMR set in a second position.

FIGS. 41 to 43 show the metallic parts inside the base (302). Each of these parts corresponds to one of the pins A through F. In this embodiment, the output terminals A, B, C and D are connected to double-sided arms (356, 352, 354, 350), respectively. Each of these arms has two electrodes (358). Pin F is connected to a spring arm (360) at the end of which two opposite electrodes (362) are provided. Similarly, pin E is connected to a spring arms (364) at the end of which are located two opposite electrodes (366). The operation of this EMR (300) is illustrated in FIGS. 42 and 43. These are views from the bottom, as if the base (302) was semi-transparent.

FIG. 42 shows the position of the parts when the control voltage is applied to pins G and H (NCC). In that case, the heat-shrinkable wire (320) forced the pivotable support (306) to pivot around the pin (308). This moved the flaps (330, 332) that are positioned between the double-sided arms (350, 352, 354, 356) and the corresponding spring arms (360, 364). The flap (332) forces the spring arm (360) of pin F to move against the side arm (352) of pin B so that pin F is in electrical engagement with pin B. On the other side, the flap (330) moves slightly away from the spring arm (364) of pin E, allowing spring arm (364) to move against the double-sided arm (356) of pin A by its natural bias design so that pin E is in electrical engagement with pin A.

FIG. 43 shows the EMR position when no control voltage is applied to pins G and H (NOC). In that case, the return spring (310) forced the pivotable support (306) to pivot around the pin (308) back to its original position. This moved the flaps (330, 332). The flap (330) forces the spring arm (364) of pin E to move against the side arm (354) of pin C so that pin E is in electrical engagement with pin C. On the other side, the flap (332) moves slightly away from the spring arm (360) of pin F, allowing spring arm (360) to move against the double-sided arm (350) of pin D by its natural bias design so that pin F is in electrical engagement with pin D.

What is claimed is:

1. An electro-mechanical relay, comprising:

a base having a transversal axis;

a rocking member operatively connected over the base, the rocking member being pivotable, with reference to the transversal axis, between a first position and a second position;

a set of contacts comprising:

a first contact provided on the base at a location facing the rocking member and being spaced-apart from the transversal axis;

a second contact having at least a portion provided on the rocking member and being in registry with the first contact, the first and second contacts being configured and disposed to be electrically engaged at the first position of the rocking member, and electrically disengaged from each other at the second position thereof;

means for biasing the rocking member towards either the first position or the second position thereof; and a pulling assembly mounted between the rocking member and a fixed location with reference to the base, the pulling assembly comprising a heat-shrinkable wire and being provided to selectively move the rocking member either towards the second position thereof when the means for biasing the rocking member are designed to bias the rocking member towards the first position thereof, or towards the first position thereof when the means for biasing the rocking member are designed to bias the rocking member towards the second position thereof.

2. The electro-mechanical relay as defined in claim 1, wherein the rocking member is operatively connected to the base through a side extension portion of the second contact, the side extension portion comprising a first part attached to a fixed location with reference to the base, and a second part acting as a flexible link and extending between the portion of the second contact provided on the rocking member, and the first part of the side extension.

3. The electro-mechanical relay as defined in claim 1, wherein the heat-shrinkable wire is held between two crimps.

4. The electro-mechanical relay as defined in claim 1, wherein the means for biasing comprise at least one spring.

5. The electro-mechanical relay as defined in claim 1, wherein the set of contacts constitutes a first set of contacts and the relay further comprises a second set of contacts, the second set of contacts comprising:

a first contact provided on the base at a location facing the rocking member and spaced apart from the transversal axis, the first contact of the second set being located opposite the first contact of the first set with reference to the transversal axis and being electrically independent therefrom; and a second contact having at least a portion provided on the rocking member and being in registry with the first contact of the second set, the first and second contacts of the second set being configured and disposed to be electrically engaged at the second position of the rocking member, and electrically disengaged from each other at the first position thereof, the second contact of the first set and the second contact of the second set being electrically connected.

6. The electro-mechanical relay as defined in claim 1, wherein the set of contacts constitutes a first set of contacts and the relay further comprises a second set of contacts, the second set of contacts comprising:

a first contact provided on the base at a location facing the rocking member and spaced apart from the transversal axis, the first contact of the second set being located on a same side than the first contact of the first set, with reference to the transversal axis, the first contacts of the first and second set being electrically independent from each other; and a second contact having at least a portion provided on the rocking member and being in registry with the first contact of the second set, the first and second contacts of the second set being configured and disposed to be electrically engaged at the first position of the rocking member, and electrically disengaged from each other at the second position thereof, the second contact of the first set and the second contact of the second set being electrically independent from each other.

7. The electro-mechanical relay as defined in claim 1, wherein the set of contacts constitutes a first set of contacts and the relay further comprises:

a second set of contacts, the second set of contacts comprising:

a first contact provided on the base at a location facing the rocking member and spaced apart from the transversal axis, the first contact of the second set being located opposite the first contact of the first set with reference to the transversal axis and being electrically independent therefrom; and a second contact having at least a portion provided on the rocking member and being in registry with the first contact of the second set, the first and second contacts of the second set being configured and disposed to be electrically engaged at the second position of the rocking member, and electrically disengaged from each other at the first position thereof, the second contact of the first set and the second contact of the second set being electrically connected;

a third set of contacts, the third set of contacts comprising:

a first contact provided on the base at a location facing the rocking member and spaced apart from the transversal axis, the first contact of the third set being located on a same side than the first contact of the first set, with reference to the transversal axis, and being electrically independent from each other; and a second contact having at least a portion provided on the rocking member and being in registry with the first contact of the third set, the first and second contacts of the third set being configured and disposed to be electrically engaged at the first position of the rocking member, and electrically disengaged from each other at the second position thereof, the second contact of the first set and the second contact of the third set being electrically independent from each other; and a fourth set of contacts, the fourth set of contacts comprising:

a first contact provided on the base at a location facing the rocking member and spaced apart from the transversal axis, the first contact of the fourth set being located on a same side than the first contact of the second set, with reference to the transversal axis, and being electrically independent from each other; and a second contact having at least a portion provided on the rocking member and being in registry with the first contact of the fourth set, the first and second contacts of the fourth set being configured and disposed to be electrically engaged at the second position of the rocking member, and electrically disengaged from each other at the first position thereof, the second contact of the third set and the second contact of the fourth set being electrically dependent.

8. The electro-mechanical relay as defined in claim 7, wherein at least some of the contacts comprise an electrode.

9. The electro-mechanical relay as defined in claim 7, wherein at least some of the contacts are double-sided.

10. The electro-mechanical relay as defined in claim 7, wherein the base member comprises a longitudinal channel passing between the first set and the third set of contacts, and between the second set and the fourth set of contacts, the rocking member having a downwardly-projecting flange extending inside the channel.

11. The electro-mechanical relay as defined in claim 1, wherein each contact includes a pin to be connected to a lead on a printed circuit board.

12. The electro-mechanical relay as defined in claim 1, wherein the first contact includes a contact point located at an end of a cantilever arm.

13. The electro-mechanical relay as defined in claim 1, further comprising an upper support located above the rocking member and connected to the base, the pulling assembly having one end connected to the upper support.

* * * * *